US009604450B2

(12) United States Patent
Reder

(10) Patent No.: US 9,604,450 B2
(45) Date of Patent: Mar. 28, 2017

(54) METHOD FOR ADAPTING RELATIVE SETTINGS OF PRINTING HEADS, AND PRINTING MACHINE

(71) Applicant: KOENIG & BAUER AG, Würzburg (DE)

(72) Inventor: Wolfgang Reder, Veitshöchheim (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 15/118,935

(22) PCT Filed: Jan. 21, 2015

(86) PCT No.: PCT/EP2015/051082

§ 371 (c)(1),
(2) Date: Aug. 15, 2016

(87) PCT Pub. No.: WO2015/128118

PCT Pub. Date: Sep. 3, 2015

(65) Prior Publication Data

US 2016/0355006 A1 Dec. 8, 2016

(30) Foreign Application Priority Data

Feb. 26, 2014 (DE) ..... 10 2014 203 420

(51) Int. Cl.
*B41J 29/38* (2006.01)
*B41J 29/393* (2006.01)
(Continued)

(52) U.S. Cl.
CPC ..... *B41J 2/04505* (2013.01); *B41J 2/04586* (2013.01); *B41J 2/21* (2013.01)

(58) Field of Classification Search
CPC ..... B41J 29/393; B41J 2/2135; B41J 29/38; B41J 2/2132; B41J 2/04543; B41J 2/04586; B41J 2/04505; B41J 2/21
(Continued)

(56) References Cited

U.S. PATENT DOCUMENTS 6,213,580 B1 4/2001 Segerstrom et al.
8,033,632 B2 10/2011 Koase
(Continued)

FOREIGN PATENT DOCUMENTS

DE 102011076899 A1 12/2012
EP 0938973 A2 9/1999
(Continued)

OTHER PUBLICATIONS

International Search Report of PCT/EP2015/051082 dated Mar. 24, 2015.

*Primary Examiner* — Jannelle M Lebron
(74) *Attorney, Agent, or Firm* — Mattingly & Malur, PC

(57) ABSTRACT

A method is provided for adapting settings, which are relative to each other, of printing heads of a printing unit of a printing machine. Data regarding settings, which are relative to each other, of at least two printing heads belonging to a first subset of printing heads are detected in a first partial detection process. Data regarding settings, which are relative to each other, of at least two printing heads belonging to a second subset of printing heads and not belonging to the first subset are detected in a second partial detection process. Data regarding at least one setting of at least one first printing head of the first subset and of at least one second printing head of the second subset, which settings are relative to each other, are detected in a complete detection process. At least the first partial detection process and the second partial detection process proceed at least partially simultaneously. At most, either the complete detection process proceeds or the first partial detection process or the second partial process proceeds at each point in time in the course of the method. The settings, which are relative to each other, of at least two of the printing heads are changed in an adjusting process. The invention further relates to a printing machine.

15 Claims, 12 Drawing Sheets

(51) Int. Cl.
*B41J 2/045* (2006.01)
*B41J 2/21* (2006.01)

(58) Field of Classification Search
USPC ..... 347/9, 12, 14, 19, 20, 40, 43
See application file for complete search history.

(56) References Cited

U.S. PATENT DOCUMENTS

| | | | | |
|---|---|---|---|---|
| 8,848,011 | B2 | 9/2014 | Soltysiak et al. | |
| 2002/0041299 | A1 | 4/2002 | Lee et al. | |
| 2010/0182382 | A1 | 7/2010 | Lee et al. | |
| 2010/0188468 | A1 | 7/2010 | Herpel et al. | |
| 2011/0273502 | A1 | 11/2011 | Eun et al. | |
| 2012/0033006 | A1 | 2/2012 | Murayama et al. | |
| 2012/0038697 | A1 | 2/2012 | Snyder et al. | |
| 2013/0038657 | A1* | 2/2013 | Viturro | B41J 29/393 347/19 |
| 2014/0085368 | A1* | 3/2014 | Mo | B41J 11/008 347/14 |

FOREIGN PATENT DOCUMENTS

| | | | |
|---|---|---|---|
| EP | 1938991 | A2 | 7/2008 |
| EP | 2202081 | A1 | 6/2010 |
| EP | 2444850 | A2 | 4/2012 |
| JP | 2003-063707 | A | 3/2003 |
| WO | 2013040455 | A1 | 3/2013 |

* cited by examiner

METHOD FOR ADAPTING RELATIVE SETTINGS OF PRINTING HEADS, AND PRINTING MACHINE

CROSS REFERENCE TO RELATED APPLICATIONS

This application is the U.S. National Phase, Under 35 U.S.C. §371, of PCT/EP2015/051082, filed January 21, 2015; published as WO 2015/128118A1 on Sep. 3, 2015 and claiming priority to DE 10 2014 203 420.5, filed Feb. 26, 2014, the disclosures of which are expressly incorporated herein in their entireties by reference.

FIELD OF THE INVENTION

The present invention relates to a method for adapting the relative settings of print heads, and to a printing press. The settings of print heads of at least one printing unit of a printing press are aligned relative to one another. In at least one first partial detection process, data regarding the settings of at least two print heads of a first subset of print heads, relative to one another, are detected. In at least one second partial detection process, data regarding the settings of at least two print heads of a second subset of print heads, which do not belong to the first subset, relative to one another, are detected. In at least one full detection process, data regarding at least one setting of at least one first print head of the first subset and at least one print head of the second subset, relative to one another, are detected. At least the at least one first partial detection process and the at least one second partial detection process are carried out at least partially simultaneously. The printing press has at least one printing unit, the at least one printing unit having at least four print heads, at least three of which are arranged as being movable relative to one another, at least in a transverse direction, which is oriented orthogonally to a transport direction provided for the transporter printing material through the at least one printing unit. The at least three groups each contain at least two of the at least four print heads.

BACKGROUND OF THE INVENTION

A variety of different printing processes for use in printing presses are known. One such printing process is inkjet printing or ink-jet printing. In this process, individual droplets of coating medium are ejected through nozzles of print heads and are transferred to a printing material so as to produce a printed image on the printing material. By actuating a plurality of nozzles individually, different printed images can be produced. Since no fixed printing form is involved, each printed product can be designed individually. This allows personalized printed products to be produced, and/or, since printing forms are dispensed with, allows small print runs of printed products to be produced at low cost.

The precise alignment of printed images on the front and back sides of a printing material that is imprinted on both sides is referred to as register (DIN 16500-2). In multicolor printing, the merging and precise correlation of individual printed images of different colors to form a single image is referred to as color-to-color registration (DIN 16500-2). Suitable measures are also necessary in inkjet printing in order to maintain color-to-color registration and/or register.

If a printing unit has more than one print head, it is important for the settings of the print heads to be aligned with one another, in order to achieve a high-quality print result. For example, the print heads must be aligned correctly with respect to their relative position and must be actuated at the proper time. Methods and/or devices which in some cases may be costly are used for this purpose.

EP 2 202 081 A1, DE 10 2011 076 899 A1 and JP 2003-063707 A each disclose a printing press in which the printing press comprises a first printing unit having at least one inkjet print head.

WO 2013/040455A1 discloses a positioning device which can be used to move a print head in and opposite at least one direction.

EP 0 938 973 A2 discloses a method in which inkjet print heads assigned to different colors of ink are aligned relative to one another in a first process, after which, for each color of ink, a print head involved in the first process is used as a reference print head, which is used for aligning other print heads of the respective ink color in relation to the reference print head.

EP 2 444 850 A2 discloses a method for aligning LED print heads relative to one another.

US 2012/0038697 A1 discloses a method for aligning print heads relative to one another.

US 2010/0182382 A1 discloses a movable sensor, which is used to detect the settings of different print heads relative to one another.

US 2011/0273502 A1 discloses a printing press and a method in which a printed image is detected by means of a sensor embodied as a sensor array. The sensor is either large enough that it does not need to be moved in order to detect the entire printed image, or this one sensor is moved along the printing material.

US 2002/0041299 A1 discloses a method and a device in which the relative positions of print heads are adjusted first in a longitudinal direction and then in a transverse direction. A detection is carried out in each case by row between adjacent print heads.

US 2012/0033006 A1 discloses a method and a printing press, in which a printed image is detected by a line sensor. Print heads assigned to an individual color of ink are aligned with one another, after which alignments of print heads assigned to different colors of ink relative to one another are carried out.

SUMMARY OF THE INVENTION

The object of the invention is to provide a method for aligning the settings of print heads relative to one another, and a printing press.

The object is attained according to the invention by at all times during the process, at most either of the at least one full detection process is underway, or the at least one first partial detection process and the at least one second partial detection process is underway. In at least one adjustment process, the settings of at least two of the print heads of the at least one printing unit relative to one another are modified. The printing press has at least two alignment sensors, by means of which for a total of at least three groups of print heads, data regarding the settings of the print heads of each group relative to one another can be detected. The at least two alignment sensors are each arranged as at least being partially movable with at least one component in the transverse direction.

In a method for aligning the settings of print heads, preferably relative to one another, of at least one and more preferably of precisely one printing unit, for example of a printing press, geometric positionings and/or actuation times, particularly droplet ejection times, for said print heads are preferably adjusted. In addition or alternatively to the geometric positionings and/or actuation times, particularly droplet ejection times, the relative settings include, for example, relative settings that relate to at least one ink density and/or at least one area coverage and/or at least one dot size of generated pixels. The settings of at least four such print heads are preferably adjusted relative to one another. In the preceding and in the following, where relative settings in the plural are mentioned, this also refers particularly to cases in which only one parameter is considered in reference to only two print heads. Each of the print heads has at least one corresponding setting that is described by the expression of the settings of the print heads relative to one another.

By dividing the process at least into at least one first partial detection process, at least one second partial detection process, and at least one full detection process, a time savings in particular over the process as a whole is achieved. Nevertheless, the at least one full detection process ensures an optimized process result. Partial detection processes are specific detection processes. The at least one full detection process is at least one specific detection process.

In the alignment of relative settings such as geometric positionings and/or actuation times, particularly droplet ejection times, the initially prevailing conditions are typically first determined in at least one detection process, for example by acquiring data regarding the relative settings, particularly by means of alignment sensors. At least in the case of geometric positionings and/or actuation times, particularly droplet ejection times, this is preferably accomplished by means of optical sensors. Each of the alignment sensors may be directed, for example, toward at least one or preferably at least two print heads and/or may be directed toward a printing material and/or a transport path of the printing material, so that it can detect a printed image, in particular at least one test print, that has been produced by at least two print heads together. The relative settings are then adjusted, preferably in at least one adjustment process. In the case of geometric positionings, for example, the positioning of the print heads relative to one another is reset in this adjustment process, more particularly the relative positions of the print heads with respect to an axial direction or transverse direction. The axial direction or transverse direction in this case is preferably a direction that extends parallel to a rotational axis of a roll of printing material and/or to a rotational axis of at least one central cylinder and/or to a rotational axis of a printing material guide element disposed in the printing unit and/or extending orthogonally to a transport direction intended for the printing material. In the case of actuation times, in particular droplet ejection times, the times at which the respective print heads eject coating medium are preferably adjusted relative to one another.

The method is preferably alternatively or additionally characterized by the fact that the data acquired in the at least one first partial detection process, particularly regarding the settings of the at least two print heads of the first subset of print heads relative to one another, and/or the data acquired in the at least one second partial detection process, particularly regarding the settings of the at least two print heads of the second subset of print heads, which do not belong to the first subset of print heads, relative to one another, and/or the data acquired in the at least one full detection process, particularly regarding at least one setting of the at least one first print head of the first subset and the at least one second print head of the second subset relative to one another, are acquired by means of at least two alignment sensors, which can be moved at least with respect to the transverse direction.

The at least one detection process and the at least one adjustment process together preferably make up at least one alignment process. Each alignment process is preferably carried out and completed before the next alignment process is begun. This ensures in particular that relative settings that have been modified enter subsequent detection processes as defined starting values. It is also possible, however, to carry out a plurality of or all detection processes first, before at least one or more or all of the adjustment processes are begun. This enables, in particular, a quick, at least partially simultaneous detection of multiple or of all relative settings of the print heads to be carried out, and enables new settings for all print heads to be derived therefrom, which can then be implemented in simultaneous alignment processes. In particular, at least the at least one first partial detection process and the at least one second partial detection process preferably proceed at least partially simultaneously.

In each detection process, data for at least two print heads, the relative settings of which are to be adjusted to one another, are preferably detected. These at least two and preferably precisely two print heads then preferably make up a group of print heads. These data are acquired from a test print image, for example, which is generated by the two print heads. A sensor then preferably scans at least one part of the test print image which contains components that come from at least one of the at least two print heads, along with components that come from at least one other of the at least two print heads. This test print image can thus be used to identify any changes to the relative settings that may be necessary, for example a change in relative ejection times and/or a change in the relative geometric position, particularly with respect to the axial direction or the transverse direction.

New settings are calculated, for example, particularly from the data acquired during the detection processes, and are then implemented in each case in a single operation. Alternatively, at least one detection process is carried out iteratively, after which a relative setting is modified, and in repeated detection processes and adjustment processes, a relative setting is found which satisfies corresponding requirements, such as requirements relating to a maximum deviation of positions of print heads relative to one another.

In at least one first partial detection process, data regarding the settings of at least two print heads of a first subset of print heads relative to one another are preferably detected. In at least one second partial detection process, data regarding the settings of at least two print heads of a second subset of print heads, which do not belong to the first subset, relative to one another are preferably detected. The at least one first partial detection process and the at least one second partial detection process are preferably carried out at least partially simultaneously. This results in a time savings, since the settings of the at least one first subset of print heads relative to one another can be detected and preferably also adjusted, while at the same time, in particular not subsequently, the settings of the at least one second subset of print heads relative to one another can be detected and preferably also adjusted.

In at least one full detection process, data regarding at least one setting of at least one first print head of the at least one first subset and at least one setting of at least one second print head of the at least one second subset relative to one another are preferably detected. An adjustment of the relative settings of the print heads of the at least one first subset and the print heads of the at least one second subset is thereby enabled. Various variants of sequences are possible. In a first variant, the settings of the print heads within the subsets relative to one another are first detected and readjusted if necessary, after which the relative settings of at least one pair of print heads of different subsets are checked, with data derived from this check being used to derive new settings for all the print heads of at least one of the two subsets. For example, first the print heads of a first subset are aligned with one another in terms of their relative axial positions, while at the same time the print heads of a second subset are aligned with one another in terms of their relative axial positions, after which the data from the full detection process are used to derive new settings for all the print heads of the first subset, which are then moved together along the same path in the axial direction. In a second variant, the settings of two print heads of different subsets relative to one another are first detected, after which the settings of all the print heads of the subsets that contain these print heads are adjusted to these respective two print heads. A simultaneous alignment process is thus carried out in the two subsets, which by definition results in a desired alignment of a full set of print heads that contains the subsets.

Preferably, the first subset contains at least two, more preferably at least three, even more preferably at least four, and more preferably still at least six print heads. Preferably, the second subset contains at least two, more preferably at least three, even more preferably at least four, and more preferably still at least six print heads.

Regardless of what takes place first, the at least one full detection process preferably does not proceed simultaneously with either the at least one first partial detection process or the at least one second partial detection process. In particular, at any time during the course of the process, at most either the at least one full detection process on the one hand or the at least one first partial detection process and/or the at least one second partial detection process on the other is carried out. Preferably, the at least one full detection process is carried out at least in part and preferably in full before the at least one first partial detection process and before the at least one second partial detection process. More preferably, the at least one full detection process is carried out at least in part and preferably in full after the at least one first partial detection process and after the at least one second partial detection process.

In at least one adjustment process, the settings of at least two of the preferably at least four print heads relative to one another are preferably modified. A partial adjustment process is a process, for example, by which the settings of print heads of one subset are aligned with one another. Preferably, at least one first partial adjustment process is provided for the at least one first subset, and at least one second partial adjustment process is provided for the at least one second subset. Preferably, at least one full adjustment process is provided for the adjustment of at least one print head of the at least one first subset and at least one print head of the at least one second subset relative to one another. The method is thus preferably characterized by the fact that, in the at least one first partial adjustment process, the settings of the at least two print heads of the at least one first subset relative to one another are modified, and/or in that, in the at least one second partial adjustment process, the settings of the at least two print heads of the at least one second subset relative to one another are modified, and/or in that, in the at least one full adjustment process, the setting of the at least one first print head of the first subset and the setting of the at least one second print head of the second subset relative to one another are modified. More preferably, in the full adjustment process, the settings of the at least one first print head of the first subset relative to all the print heads of the second subset are modified. Partial adjustment processes are specific adjustment processes. The at least one full adjustment process is at least one specific adjustment process.

As described, the settings of the at least two print heads relative to one another are modified based on at least the data that are acquired during the at least one first partial detection process and/or the data that are acquired in the at least one second partial detection process and/or the data that are acquired in the full detection process.

Preferably, the at least one first partial detection process and the at least one first partial adjustment process together make up at least one first partial alignment process, and/or the at least one second partial detection process and the at least one second partial adjustment process together make up at least one second partial alignment process, and/or the at least one full detection process and the at least one full adjustment process together make up at least one full alignment process. Partial alignment processes are specific alignment processes. The at least one full alignment process is at least one specific alignment process.

The at least one first partial alignment process and the at least one second partial alignment process preferably proceed at least partially and more preferably fully simultaneously. This is the case particularly when the at least one first partial detection process and the at least one second partial detection process proceed simultaneously. In that case, however, partial adjustment processes preferably also proceed simultaneously. Preferably, the at least one full alignment process proceeds, at least in part and preferably in full, after the at least one first partial alignment process and after the at least one second partial alignment process. However, it is also possible for the at least one full alignment process to proceed, at least in part and preferably in full, before the at least one first partial alignment process and before the at least one second partial alignment process.

Preferably, the method is alternatively or additionally characterized by the fact that at least the at least one first partial alignment process and the at least one second partial alignment process proceed at least partly simultaneously, and/or in that the at least one full alignment process does not proceed simultaneously with either the at least one first partial alignment process or the at least one second partial alignment process, and/or in that at any time during the course of the process, at most either the at least one full alignment process or the at least one first partial alignment process and/or the at least one second partial alignment process is underway.

The first subset and the second subset preferably have no intersection. Each print head therefore preferably belongs to at most the at least one first subset or the at least one second subset. Otherwise, simultaneous detection and/or adjustment would be hampered.

In particular, first in a first partial alignment process, the relative positions of at least two print heads of the first subset of print heads are aligned with one another, and in a second partial alignment process, the relative positions of at least two other print heads of the second subset of print heads are aligned with one another, and preferably before this, or more preferably after this, in the at least one full alignment process, a relative position of at least one print head of the first subset and a relative position of at least one print head of the second subset are aligned with one another.

Preferably, at least one relative setting of each of at least two and more preferably of each of precisely two print heads is detected by means of one alignment sensor in each case. For this purpose, preferably at least one, in particular precisely one of the at least two print heads of the first subset, for example, is specified as the primary master print head of the first subset, for example. Data regarding the settings of at least one other of the at least two print heads, for example, of the first subset relative to this primary master print head are then preferably detected in the partial detection process. This at least one other print head is a slave print head, in particular the primary slave print head, the settings of which are to be aligned with those of the master print head. Preferably, but not necessarily, the settings of these at least two print heads are then aligned, for example by adjusting the settings of the at least one slave print head. Master print heads and slave print heads are preferably positioned relative to one another such that their operating regions border one another or overlap with one another in the axial direction. Optionally, additional slave print heads are aligned particularly with the primary master print head in the same manner, more preferably all of the print heads, the operating regions of which border those of particularly the primary master print head with respect to the axial direction or the transverse direction and have not yet been reset in the process, and the operating regions of which coincide less than 50% with the operating region of the master print head with respect to the axial direction or the transverse direction.

Then, particularly subsequently, the at least one other of the at least two print heads, in particular a previously primary slave print head, is designated as the secondary master print head, for example of the first subset. Additional print heads, for example those of the first subset, are then designated particularly as secondary slave print heads, in particular those whose operating regions border and/or overlap those of particularly the secondary master print head and have not yet been reset in the process. Data regarding settings of at least one such secondary slave print head of the at least two print heads of the first subset relative to this secondary master print head are then detected in the partial detection process. These data are then used to derive new relative settings, on the basis of which the settings of the at least one secondary slave print head are adjusted relative to the secondary master print head. Thus all primary slave print heads and all secondary slave print heads are already aligned with the primary master print head. This operation is repeated similarly until the entire first subset has correspondingly aligned settings relative to the primary master print head.

In the at least one second detection process and/or alignment process, the at least one second subset of print heads is treated similarly, preferably simultaneously with the at least one first detection process and/or alignment process.

The full detection process then preferably proceeds similarly, with a print head of the first subset being designated as the overall master print head and a print head of the second subset being designated as the overall slave print head. New relative settings between the overall master print head and the overall slave print head are defined, and in the full alignment process, the entire second subset is reset in the same manner based on these new relative settings, for example, it is moved in the axial direction or the transverse direction. In particular, therefore, in the at least one full detection process, the at least one first print head of the first subset is designated as the overall master print head, and in the full detection process, data regarding the settings of the at least one second print head of the second subset, which is preferably designated as the overall slave print head, in relation to this overall master print head are detected. The operating range of the overall master print head and the operating range of the overall slave print head border one another preferably in the axial direction or the transverse direction, or overlap one another preferably in the axial direction or the transverse direction. The simultaneous processes within the subsets of print heads result in a time savings. It is then necessary only to bring the subsets at least into alignment with one another in a relatively simple process based on the same principle.

If the full detection process is carried out prior to the partial detection processes, the two print heads of the respective subsets that are involved in the full detection process are used as master print heads in the first step of the subsequent partial detection processes. The partial detection processes then preferably proceed precisely as described above.

In corresponding embodiments, at least one third or more subsets of the total number of print heads may also be designated, so that three or more partial detection processes and/or three or more partial adjustment processes and/or three or more partial alignment processes can be carried out simultaneously, and corresponding with this, in particular subsequently, two or more full alignment processes can be carried out. Further incrementalization can therefore also be achieved by further subdividing the subsets into even smaller subsets.

The method is preferably alternatively or additionally characterized by the fact that at least one alignment sensor, and more preferably at least one of the at least two movable alignment sensors, is moved, at least temporarily, at least in the transverse direction, during the at least one first partial detection process.

The method is preferably alternatively or additionally characterized by the fact that at least one alignment sensor, and more preferably at least one of the at least two movable alignment sensors, is moved, at least temporarily, at least in the transverse direction, during the at least one second partial detection process.

The method is preferably alternatively or additionally characterized by the fact that at least one alignment sensor and more preferably at least one of the at least two movable alignment sensors is moved, at least temporarily, at least in the transverse direction, between the at least one first and/or the at least one second partial detection process on the one hand and the at least one full detection process on the other. In this case, it is irrelevant whether the at least one full detection process is carried out before or after the at least one first or the at least one second partial detection process.

The method is preferably alternatively or additionally characterized by the fact that at least one alignment sensor, and more preferably at least one of the at least two movable alignment sensors, is moved, at least temporarily, at least in the transverse direction, independently of any movement of the print heads.

The method is preferably alternatively or additionally characterized by the fact that the at least two alignment sensors are moved, at least temporarily, independently of one another, at least in the transverse direction.

The method is preferably alternatively or additionally characterized by the fact that each of the at least two alignment sensors detects at least one printed image positioned on at least one printing material and/or on at least one transfer component, and/or detects at least two particularly adjacent print heads.

The method and/or the printing press is preferably alternatively or additionally characterized by the fact that the at least one first subset and the at least one second subset, and more preferably also the at least one full set, each have at least one print head, by means of which a common coating medium can be applied and/or an application of the common coating medium can be influenced. The method and/or the printing press is preferably alternatively or additionally characterized by the fact that all the print heads of the at least one first subset and the at least one second subset, and more preferably also of the at least one full set, are characterized by the fact that each of them can be used to apply a common coating medium and/or to influence the application of the common coating medium.

In the foregoing and in the following, the term printing fluid refers to inks and printing inks, but also to varnishes and paste-like materials. Printing fluids are preferably materials that are and/or can be transferred onto a printing material by means of a printing press or at least one printing unit of the printing press, and which create on the printing material a texture, preferably in finely structured form and/or not merely over a large area, which is preferably visible and/or perceptible by the senses and/or detectable by machine. Inks and printing inks are preferably solutions or dispersions of at least one colorant in at least one solvent. Suitable solvents include water and/or organic solvents, for example. Alternatively or additionally, the printing fluid may be embodied as printing fluid that is cured under UV light. Inks are relatively low-viscosity printing fluids and printing inks are relatively high-viscosity printing fluids. Inks preferably contain no binding agent or relatively little binding agent, whereas printing inks preferably contain a relatively large amount of binding agent, and further preferably contain additional auxiliary agents. Colorants may be pigments and/or dyes, with pigments being insoluble in the application medium, whereas dyes are soluble in the application medium.

In the interest of simplicity, in the foregoing and in the following—unless explicitly distinguished and identified accordingly—the term "printing ink" is understood as a liquid or at least flowable coloring fluid to be used for printing in the printing press, and is not restricted to the higher viscosity coloring fluids more frequently associated colloquially with the expression "printing ink" for use in rotary printing presses; in addition to these higher viscosity coloring fluids, said term particularly also includes lower viscosity coloring fluids such as "inks", in particular inkjet inks, but also powdered coloring fluids, such as toners, for example. Thus in the foregoing and in the following, when printing fluids and/or inks and/or printing inks are mentioned, this also includes colorless varnishes. In the foregoing and in the following, when printing fluids and/or inks and/or printing inks are mentioned, this also preferably includes particularly means for pretreating (precoating) the printing material. The term coating medium may be alternatively understood as synonymous with the term printing fluid.

The method and/or the printing press are preferably alternatively or additionally characterized by the fact that print heads of the at least one second subset are arranged in only one direction with respect to the transverse direction, proceeding from each print head of the at least one first subset, and/or in that print heads of the at least one first subset are arranged in only one direction with respect to the transverse direction, proceeding from each print head of the at least one second subset.

The printing unit is a printing unit of a printing press, for example, which has a plurality of printing units, for example, especially two. The printing press, and particularly the printing unit, preferably has at least four print heads, at least three of which are arranged so as to be movable relative to one another, preferably independently of one another, at least in the axial direction or transverse direction, and are preferably oriented orthogonally to the transport direction provided for the transport of printing material through the printing unit. The printing press, and more preferably the printing unit, preferably has at least two particularly movable alignment sensors. By means of the at least two alignment sensors, for a total of preferably at least three groups of print heads, data regarding the settings of the print heads in each said group relative to one another can preferably be detected. The at least three groups each preferably contain at least two of the at least four print heads. Preferably, the at least three groups each contain precisely two print heads. Preferably at least one group, and more preferably each group, is made up of the two print heads in particular, the relative settings of which are detected at a given time. At least one and preferably each such group preferably has a master print head and at least one, more preferably precisely one slave print head. Preferably, at least one relative setting of all the print heads in each group can be detected simultaneously by means of one detection sensor, for example by detecting a test print image that is produced by all the print heads of the group together. As described above, some slave print heads are designated in subsequent processes as master print heads. This means, in particular, that the at least three groups preferably have intersections. At least one print head is thus assigned to at least two groups in succession.

The at least two alignment sensors are preferably each disposed so as to be at least partially movable with at least one component in the axial direction or the transverse direction. This enables the at least two alignment sensors to be moved in particular to a plurality of positions, and enables data regarding the relative settings of the print heads of a plurality of groups to be detected in succession. For example, between two partial detection processes and/or between a partial detection process and a full detection process, at least one alignment sensor is moved to a different position, in particular with at least one component in the axial direction or the transverse direction. Each print head that is movable in the axial direction or the transverse direction preferably has its own drive, in particular at least for movements in the axial direction or the transverse direction. Each alignment sensor that is movable in the axial direction or the transverse direction preferably has its own sensor drive, in particular at least for movements in the axial direction or the transverse direction. As described above, the relative settings are relative geometric positionings and/or actuation times, for example, in particular droplet ejection times for the print heads. More preferably, the printing unit is characterized by the fact that the printing unit has at least four print heads arranged in different axial positions or transverse positions with respect to the axial direction or transverse direction, and/or in that the printing unit has at least two print heads arranged in different longitudinal positions with respect to the transport direction provided for the transport of printing material. Preferably, the at least two alignment sensors can be directed toward the printing material and/or are arranged such that they are and/or can be directed toward the transport path provided for the transport of printing material.

Alternatively or additionally, the printing press is preferably characterized by the fact that at least two and more preferably all of the at least two alignment sensors are arranged such that they can each be moved, independently of one another and/or independently of the print heads, at least partially with at least one component in the transverse direction.

Alternatively or additionally, the printing press is preferably characterized by the fact that at least one of the at least two alignment sensors has its own sensor drive which is different from a sensor drive of another of the at least two alignment sensors, and/or in that each movable alignment sensor has its own sensor drive.

Alternatively or additionally, the printing press is preferably characterized by the fact that the printing unit has at least four, more preferably at least six and even more preferably at least twelve print heads, which are assigned to the same coating medium reservoir and which are arranged at least partially offset from one another in the transverse direction, as viewed in pairs.

Alternatively or additionally, the printing press is preferably characterized by the fact that the printing unit has at least one double row of print heads, more preferably at least two, even more preferably at least four, and more preferably still at least eight double rows of print heads, each double row particularly having two rows of print heads offset from one another in the transverse direction, each row having in particular at least two, more preferably at least three, even more preferably at least four and more preferably still at least six print heads.

Alternatively or additionally, the printing press is preferably characterized by the fact that each of the at least two alignment sensors is and/or can be directed toward a printing material and/or toward at least one transfer component and/or toward at least two particularly adjacent print heads.

BRIEF DESCRIPTION OF THE DRAWINGS

Embodiment examples of the invention are illustrated in the set of drawings and will be specified in greater detail in the following.

The drawings show.

DESCRIPTION OF THE PREFERRED EMBODIMENT

Figure 1A:
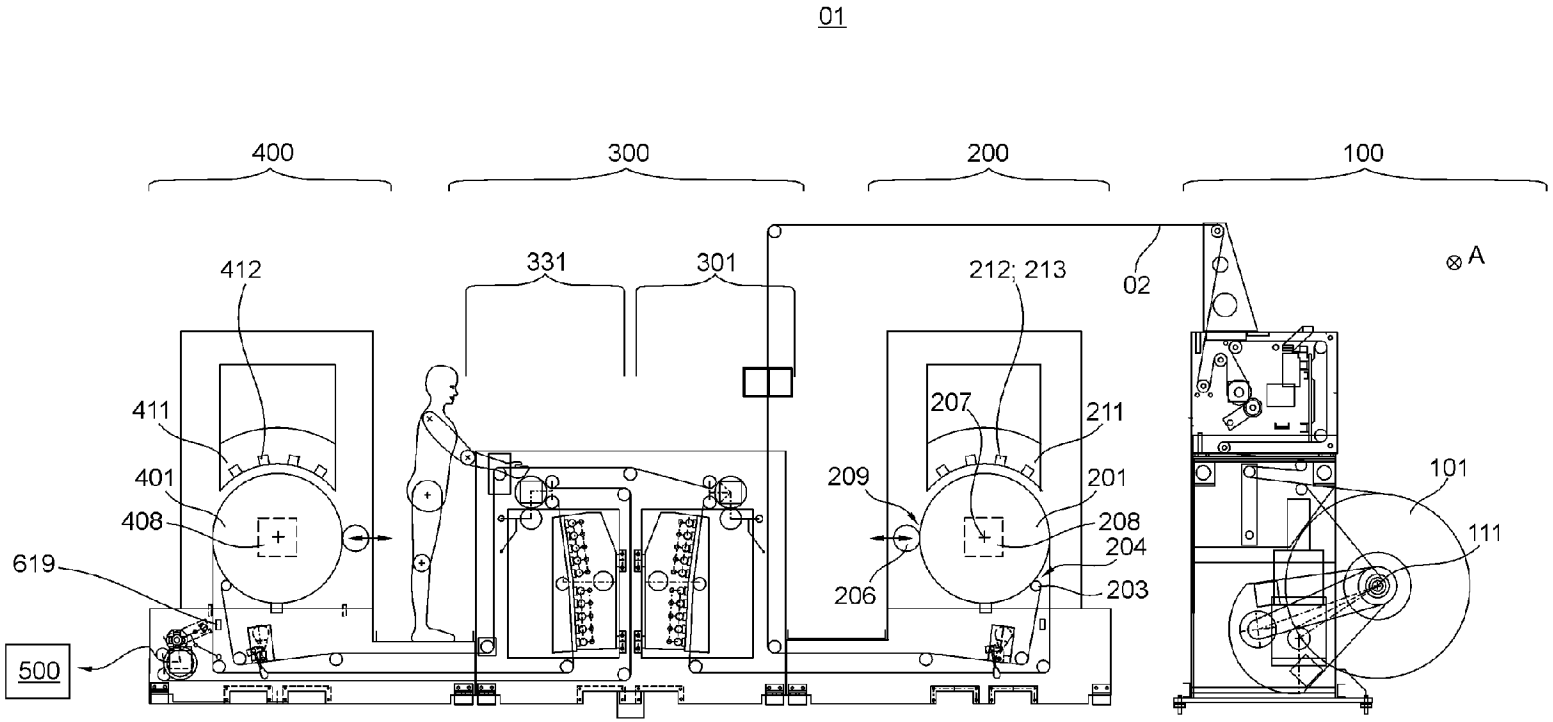
FIG. 1*a* a schematic representation of a web-fed printing press.
Figure 1B:
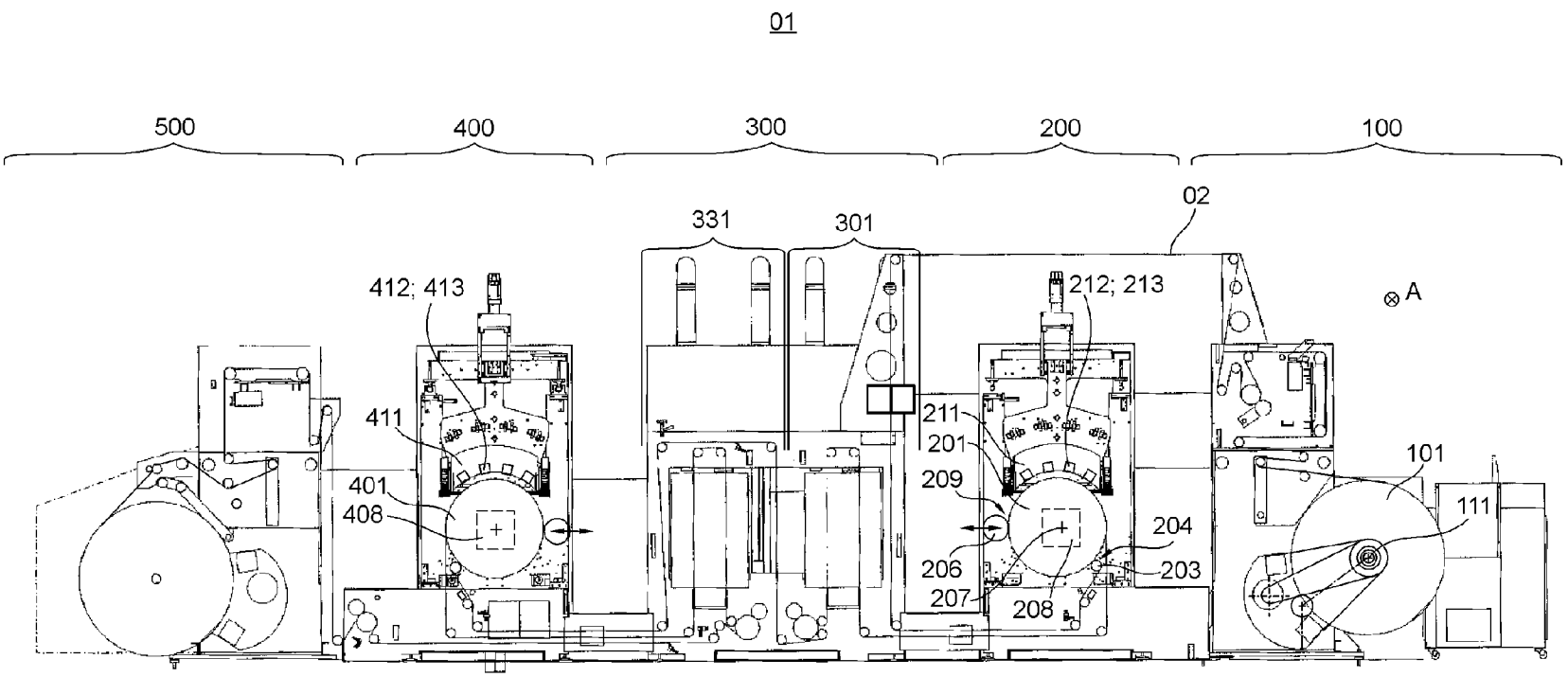
FIG. 1*b* a schematic representation of a web-fed printing press having an alternative web path.
Figure 2A:
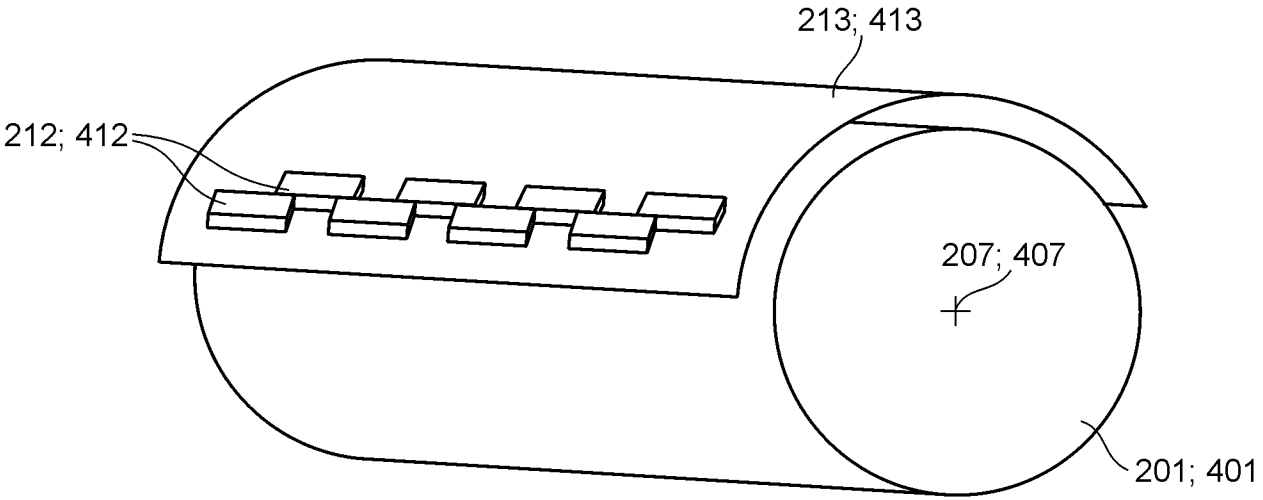
FIG. 2*a* a schematic representation of a part of a printing unit having a double row of print heads.
Figure 2B:
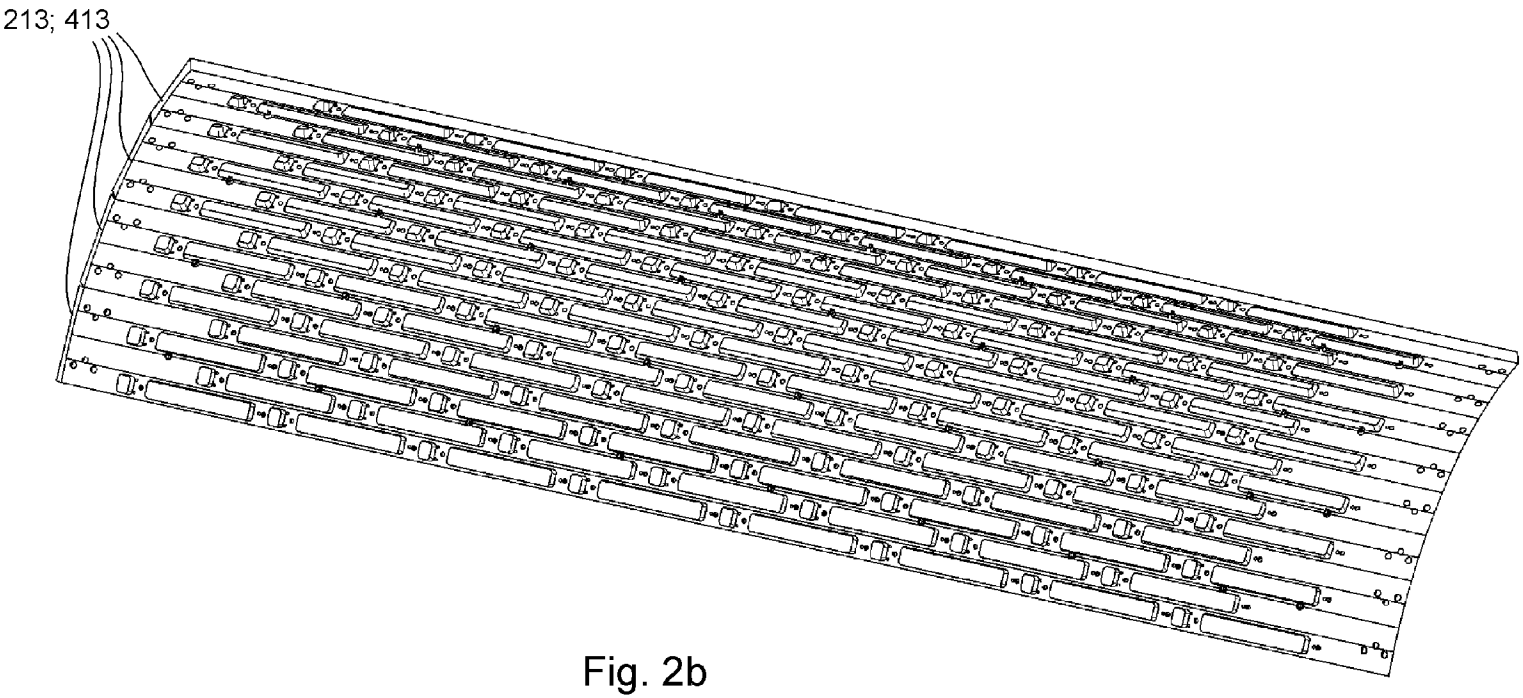
FIG. 2*b* a schematic representation of at least one nozzle bar having a plurality of double rows of positions intended for print heads.
Figure 3:
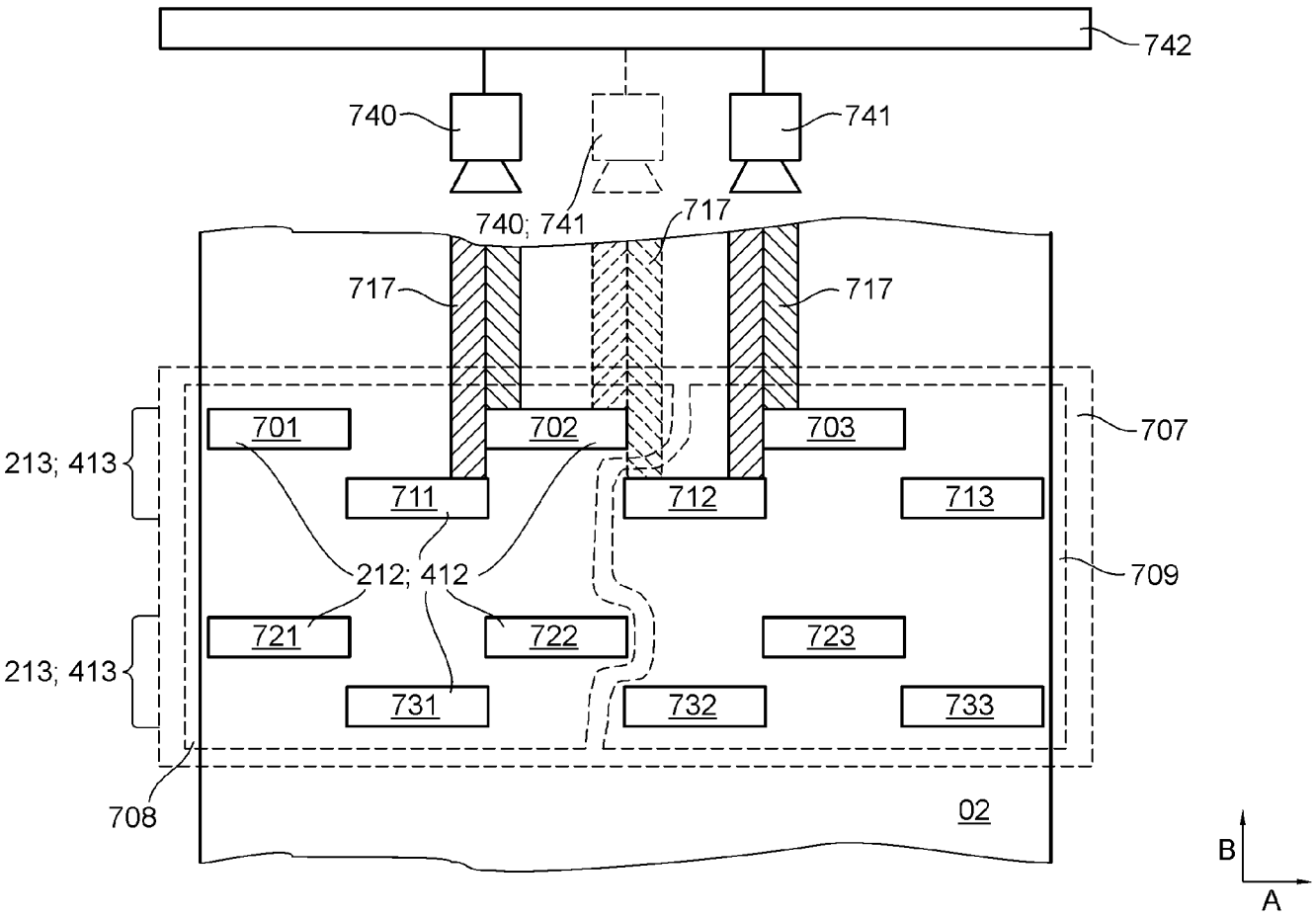
FIG. 3 a schematic representation of a printing material, a full set of print heads, and various alignment sensors.

A printing press 01 comprises, for example, at least one printing material source 100, at least one first printing unit 200, preferably at least one first dryer 301, preferably at least one second printing unit 400 and preferably at least one second dryer 331, and preferably at least one post-processing unit 500. Printing press 01 is further preferably embodied as an inkjet printing press 01. Printing press 01 is preferably embodied as a web-fed printing press 01, and more preferably as a web-fed inkjet printing press 01. Printing press 01 is embodied, for example, as a rotary printing press 01, for example as a web-fed rotary printing press 01, in particular a web-fed rotary inkjet printing press 01. In the case of a web-fed printing press 01, printing material source 100 is embodied as a roll unwinding device 100, for example. In the case of a sheet-fed printing press or a sheet-fed rotary printing press, printing material source 100 is embodied as a sheet feeder, for example. In printing material source 100, at least one printing material 02 is preferably aligned, preferably with respect to at least one edge of said printing material 02. Printing material 02 is at least one web-type printing material web 02, for example, that is to say a printing material web 02, for example a paper web 02 or a textile web 02 or a film 02, for example a plastic film 02 or a metal film 02. An axial direction A is preferably a direction A that extends parallel to a rotational axis 111 of a roll of printing material 101 and/or to a rotational axis 207; 407 of at least one central cylinder 201; 401 and/or to a rotational axis of a printing material guiding element located in the first printing unit 200. A transport path of the at least one printing material 02 and particularly the printing material web 02 downstream of the at least one printing material source 100 preferably extends through the at least one first printing unit 200, where printing material 02 and particularly printing material web 02 is provided with at least one printed image, preferably by means of at least one coating medium, in particular at least one printing ink, at least on one side, and preferably in combination with the at least one second printing unit 400, preferably on both sides.

After passing through the at least one first printing unit 200, the transport path of printing material 02 and particularly printing material web 02 passes through the at least one first dryer 301, for example, where the applied printing ink is dried. Printing ink in the foregoing and in the following is generally understood as a coating medium, including a varnish. The at least one first dryer 301 is preferably a component of a dryer unit 300. The at least one post-processing unit 500 is embodied, for example, as at least one folding apparatus 500 and/or as a winding apparatus 500 and/or as at least one planar delivery unit 500. In the at least one folding apparatus 500, printing material 02, preferably imprinted on both sides, is preferably further processed to produce individual printed products.

In the following, a web-fed printing press 01 will be described in greater detail. Corresponding specifics may also be applied to other printing presses 01, for example to sheet-fed printing presses, where such specifics are not incompatible. Rolls of printing material 101, which are preferably used in roll unwinding device 100, preferably each have a core onto which web-type printing material 02 for use in web-fed printing press 01 is wound. Printing material web 02 preferably has a width of 700 mm to 2000 mm, but can also have any smaller or preferably greater width.

A working width of printing press 01 is a dimension that preferably extends orthogonally to the provided transport path of printing material 02 through the at least one first printing unit 200, more preferably in axial direction A. The working width of printing press 01 preferably corresponds to the maximum width that a printing material 02 may have if it will be processed in printing press 01, that is to say, the maximum printing material width that can be processed in printing press 01.

The first printing unit 200 is preferably situated downstream of roll unwinding device 100 along the transport path of printing material 02. First printing unit 200 has at least one first central printing cylinder 201, or central cylinder 201, for example. In the following, when a central cylinder 201 is mentioned, a central printing cylinder 201 is always meant. During printing operation, printing material web 02 preferably wraps at least partially around first central cylinder 201. A wrap angle in this case is preferably at least 180° and more preferably at least 270°. The wrap angle is the angle, measured in the circumferential direction, of the circumferential cylinder surface of first central cylinder 201 along which printing material 02, and particularly printing material web 02, is in contact with first central cylinder 201 Printing material web 02 wraps, for example, around part of a first turning roller 203 and is turned by said roller such that the transport path of printing material web 02 in a first gap 204 extends both tangentially to the first turning roller 203 and tangentially to the first central cylinder 201

At least one first cylinder 206, embodied as first impression cylinder 206, is preferably provided in first printing unit 200 In a state in which it is thrown onto first central cylinder 201, first impression cylinder 206, together with first central cylinder 201, preferably forms a first impression nip 209. By means of first turning roller 203 and/or preferably by means of first impression cylinder 206, printing material web 02 is preferably placed in planar contact, and more preferably in a specific and known position, against first central cylinder 201.

First central cylinder 201 preferably has its own first drive motor 208, assigned to first central cylinder 201, which drive motor is preferably embodied as an electric motor 208 and is more preferably embodied as a direct drive 208 and/or an independent drive 208 of first central cylinder 201. A direct drive 208 in this case is understood as a drive motor 208 which is connected to the at least one first central cylinder 201 so as to transmit torque or be capable of transmitting torque, without interconnection of additional rotational elements that are in contact with printing material 02. An independent drive 208 in this context is understood as a drive motor 208 which is embodied as the drive motor 208 exclusively of the at least one first central cylinder 201.

On first drive motor 208 of first central cylinder 201 and/or on first central cylinder 201 itself, a first rotational angle sensor is preferably provided, which is embodied to measure and/or be capable of measuring an angular position of first drive motor 208 and/or of first central cylinder 201 itself, and to transmit and/or be capable of transmitting said measurement to a higher level machine controller. The first rotational angle sensor is embodied, for example, as a rotation encoder or absolute value encoder. A rotational angle sensor of this type can be used to determine in absolute terms the angular position of first drive motor 208 and/or preferably the angular position of first central cylinder 201, preferably by means of the higher level machine controller.

Additionally or alternatively, first drive motor 208 of first central cylinder 201 is connected in terms of circuitry to the machine controller such that the machine controller is informed at all times regarding the angular position of first drive motor 208 and therefore at the same time regarding the angular position of first central cylinder 201, on the basis of target data relating to the angular position of first drive motor 208, predefined by the machine controller to first drive motor 208 of first central cylinder 201. In particular, a region of the machine controller that specifies the rotational angle position or angular position of first central cylinder 201 and/or of first drive motor 201 is preferably connected directly to a region of the machine controller that controls at least one print head 212; 701; 702; 703; 711; 712; 713; 721; 722; 723; 731; 732; 733 of first printing unit 200.

At least one first printing element 211 is arranged inside first printing unit 200. The at least one first printing element 211 is preferably situated downstream of first impression cylinder 206 in the direction of rotation of first central cylinder 201 and therefore along the transport path of printing material web 02, preferably so as to act and/or be capable of acting on, and/or as aligned and/or capable of being aligned toward the at least one first central cylinder 201. The at least one first printing element 211 is preferably embodied as a first inkjet printing element 211, and is also referred to as first ink-jet printing element 211. The at least one first printing element 211 preferably has at least one nozzle bar 213 and more preferably a plurality of nozzle bars 213. The at least one first printing element 211, and therefore the at least one first printing unit 200, preferably comprises the at least one first print head 212; 412; 701; 702; 703; 711; 712; 713; 721; 722; 723; 731; 732; 733, which is preferably embodied as inkjet print head 212; 412; 701; 702; 703; 711; 712; 713; 721; 722; 723; 731; 732; 733. Preferably, each at least one nozzle bar 213 has at least one print head 212; 412; 701; 702; 703; 711; 712; 713; 721; 722; 723; 731; 732; 733, and preferably a plurality of print heads 212; 412; 701; 702; 703; 711; 712; 713; 721; 722; 723; 731; 732; 733. Each print head 212; 412; 701; 702; 703; 711; 712; 713; 721; 722; 723; 731; 732; 733 preferably has a plurality of nozzles, from which droplets of coating medium, in particular droplets of printing ink, are and/or can be ejected. A nozzle bar 213 in this case is a component that preferably extends across at least 80% and more preferably at least 100% of the working width of printing press 01 and serves as a support for the at least one print head 212; 412; 701; 702; 703; 711; 712; 713; 721; 722; 723; 731; 732; 733. The axial length of the body of the at least one first central cylinder 201 is preferably at least as great as the working width of printing press 01. A single nozzle bar or a plurality of nozzle bars 213 is/are provided per printing element 211. Each nozzle is preferably assigned a clearly defined target region with respect to direction A of the width of printing material web 02 and preferably with respect to direction A particularly of rotational axis 207 of the at least one first central cylinder 201. Each target region of a nozzle, particularly with respect to the circumferential direction of the at least one first central cylinder 201, is preferably clearly defined, at least during printing operation. A target region of a nozzle is particularly the spatial region, particularly substantially rectilinear, that extends outward from said nozzle in an ejecting direction of said nozzle.

The at least one first nozzle bar 213 preferably extends orthogonally to the defined transport path of printing material 02 across the working width of printing press 01. The at least one nozzle bar 213 preferably has at least one row of nozzles. The at least one row of nozzles, as viewed in axial direction A, preferably has nozzle openings at regular intervals, for example, across the entire working width of printing press 01 and/or across the entire width of the body of the at least one first central cylinder 201. Preferably, a plurality of print heads 212; 412; 701; 702; 703; 711; 712; 713; 721; 722; 723; 731; 732; 733 are arranged side by side in axial direction A on the at least one nozzle bar 213. Since such individual print heads 212; 412; 701; 702; 703; 711; 712; 713; 721; 722; 723; 731; 732; 733 are usually not equipped with nozzles up to the edges of their housing, preferably at least two and more preferably precisely two rows of print heads 212; 412; 701; 702; 703; 711; 712; 713; 721; 722; 723; 731; 732; 733, extending in axial direction A, are preferably arranged offset from one another in the circumferential direction of first central cylinder 201, preferably such that successive print heads 212; 412; 701; 702; 703; 711; 712; 713; 721; 722; 723; 731; 732; 733 in axial direction A are preferably assigned alternatingly to one of the at least two rows of print heads 212; 412; 701; 702; 703; 711; 712; 713; 721; 722; 723; 731; 732; 733, preferably alternating constantly between a first and a second of two rows of print heads 212; 412; 701; 702; 703; 711; 712; 713; 721; 722; 723; 731; 732; 733. Two such rows of print heads 212; 412; 701; 702; 703; 711; 712; 713; 721; 722; 723; 731; 732; 733 form a double row of print heads 212; 412; 701; 702; 703; 711; 712; 713; 721; 722; 723; 731; 732; 733. Each double row of print heads 212; 412; 701; 702; 703; 711; 712; 713; 721; 722; 723; 731; 732; 733 has, for example, between five and twenty-five print heads 212; 412; 701; 702; 703; 711; 712; 713; 721; 722; 723; 731; 732; 733 and more preferably seven or fourteen print heads 212; 412; 701; 702; 703; 711; 712; 713; 721; 722; 723; 731; 732; 733. The at least one row of nozzles is preferably not embodied as a single linear row of nozzles, and instead results as the sum of a plurality of individual rows of nozzles, more preferably two, arranged offset from one another in the circumferential direction.

If a print head 212; 412; 701; 702; 703; 711; 712; 713; 721; 722; 723; 731; 732; 733 has a plurality of nozzles, all the target regions of the nozzles of said print head 212; 412; 701; 702; 703; 711; 712; 713; 721; 722; 723; 731; 732; 733 together form an operating region of said print head 212; 412; 701; 702; 703; 711; 712; 713; 721; 722; 723; 731; 732; 733. Operating regions of print heads 212; 412; 701; 702; 703; 711; 712; 713; 721; 722; 723; 731; 732; 733 of a nozzle bar 213 and particularly of a double row of print heads 212; 412; 701; 702; 703; 711; 712; 713; 721; 722; 723; 731; 732; 733 border one another as viewed in axial direction A and/or overlap as viewed in axial direction A. This serves to ensure that target regions of nozzles of the at least one nozzle bar 213 and/or particularly of each double row of print heads 212; 412; 701; 702; 703; 711; 712; 713; 721; 722; 723; 731; 732; 733 are spaced at regular and preferably periodic distances, as viewed in axial direction A, even if print head 212; 412; 701; 702; 703; 711; 712; 713; 721; 722; 723; 731; 732; 733 is not continuous in axial direction A. In any case, an entire operating region of the at least one nozzle bar 213 preferably extends across at least 90% and more preferably across 100% of the working width of printing press 01 and/or across the entire width of the body of the at least one first central cylinder 201 in axial direction A. On one or on both sides with respect to axial direction A, a narrow region of printing material web 02 and/or of the body of first central cylinder 201 may be provided, which is not assigned to the operating region of nozzle bar 213 An entire operating region of the at least one nozzle bar 213 is preferably composed of all the operating regions of the print heads 212; 412; 701; 702; 703; 711; 712; 713; 721; 722; 723; 731; 732; 733 of said at least one nozzle bar 213 and is preferably composed of all the target regions of nozzles of said print heads 212; 412; 701; 702; 703; 711; 712; 713; 721; 722; 723; 731; 732; 733 of said at least one nozzle bar 213. An entire operating region of a double row of print heads 212; 412; 701; 702; 703; 711; 712; 713; 721; 722; 723; 731; 732; 733, as viewed in axial direction A, preferably corresponds to the operating region of the at least one nozzle bar 213.

The at least one nozzle bar 213 preferably has a plurality of rows of nozzles in the circumferential direction with respect to the at least one first central cylinder 201. Preferably, each print head 212; 412; 701; 702; 703; 711; 712; 713; 721; 722; 723; 731; 732; 733 has a plurality of nozzles, which are further preferably arranged in a matrix of a plurality of lines in axial direction A and/or a plurality of columns, preferably in the circumferential direction of the at least one first central cylinder 201. Columns of this type more preferably are arranged extending at an angle relative to the circumferential direction, for example in order to increase the resolution of a printed image. Thus, in each case one line of nozzles and one column of nozzles preferably form an angle not equal to 90°. In a direction orthogonal to axial direction A, particularly in transport direction B along the defined transport path of printing material 02 and/or in the circumferential direction with respect to the at least one central cylinder 201, preferably a plurality of rows of print heads 212; 412; 701; 702; 703; 711; 712; 713; 721; 722; 723; 731; 732; 733, more preferably four double rows, and even more preferably eight double rows of print heads 212; 412; 701; 702; 703; 711; 712; 713; 721; 722; 723; 731; 732; 733 are arranged in succession. Further preferably, at least during printing operation, a plurality of rows of print heads 212; 412; 701; 702; 703; 711; 712; 713; 721; 722; 723; 731; 732; 733, more preferably four double rows, and even more preferably eight double rows of print heads 212; 412; 701; 702; 703; 711; 712; 713; 721; 722; 723; 731; 732; 733 are arranged in succession in the circumferential direction with respect to the at least one first central cylinder 201, aligned toward the at least one first central cylinder 201.

Thus at least during printing operation, print heads 212; 412; 701; 702; 703; 711; 712; 713; 721; 722; 723; 731; 732; 733 are preferably aligned such that the nozzles of each print head 212; 412; 701; 702; 703; 711; 712; 713; 721; 722; 723; 731; 732; 733 point substantially in the radial direction toward the circumferential cylinder surface of the at least one first central cylinder 201. Deviations of radial directions within a tolerance range of preferably 10° at most and more preferably 5° at most are considered substantially radial directions. This means that the at least one print head 212; 412; 701; 702; 703; 711; 712; 713; 721; 722; 723; 731; 732; 733 aligned toward the circumferential surface of the at least one first central cylinder 201 is aligned with respect to rotational axis 207 of the at least one first central cylinder 201 in a radial direction toward the circumferential surface of the at least one first central cylinder 201. Said radial direction is a radial direction with respect to rotational axis 207 of the at least one first central cylinder 201. A printing ink of a specific color, for example one of each of the colors black, cyan, yellow and magenta, or a varnish, for example a clear varnish, preferably is and/or can be assigned to each double row of print heads 212; 412; 701; 702; 703; 711; 712; 713; 721; 722; 723; 731; 732; 733. The corresponding inkjet printing element 211 is preferably embodied as a multicolor printing element 211, in particular a four-color printing element 211, and enables single-sided, multicolor, in particular four-color imprinting of printing material web 02. It is also possible to use one printing element 211 to print with fewer or more different colors, for example additional special colors. In one embodiment, at least during printing operation, a plurality of rows of print heads 212; 412; 701; 702; 703; 711; 712; 713; 721; 722; 723; 731; 732; 733, more preferably four double rows and even more preferably eight double rows of print heads 212; 412; 701; 702; 703; 711; 712; 713; 721; 722; 723; 731; 732; 733 are arranged in succession, aligned toward at least one surface of at least one transfer element, for example at least one transfer cylinder and/or at least one transfer belt.

The at least one print head 212; 412; 701; 702; 703; 711; 712; 713; 721; 722; 723; 731; 732; 733 acts to generate droplets of coating medium, preferably using the drop-on-demand method, in which droplets of coating medium are produced selectively as needed. At least one piezoelectric element is preferably used per nozzle, which is capable of reducing a volume filled with coating medium by a certain percentage at high speed when a voltage is applied and/or when an applied voltage is adjusted. This causes coating medium to be displaced and ejected through a nozzle connected to the volume that is filled with coating medium, forming at least one droplet of coating medium. By applying different voltages to the piezoelectric element, the actuating path of the piezoelectric element and as a result the reduction in the volume and thus the size of the coating medium droplets can be influenced. This allows color gradations to be achieved in the resulting printed image, for example without necessarily altering the number of droplets used to produce the printed image (amplitude modulation). It is also possible to use at least one heating element per nozzle, which element generates a gas bubble at high speed in a volume filled with coating medium by vaporizing the coating medium. The additional volume of the gas bubble displaces coating medium, which is in turn ejected through the corresponding nozzle, forming at least one droplet of coating medium.

In the drop-on-demand method, the target position of the respective coating medium droplet on the moving printing material web 02 can be defined with respect to the circumferential direction of the at least one first central cylinder 201 based solely on an ejection time of the respective coating medium droplet and a rotational speed of first central cylinder 201 and/or based on the rotational position of first central cylinder 201. Actuating each nozzle individually allows coating medium droplets to be transferred only at selected times and at selected locations from the at least one print head 212; 412; 701; 702; 703; 711; 712; 713; 721; 722; 723; 731; 732; 733 onto printing material web 02. This is carried out as a function of the rotational speed and/or the rotational angle position of the at least one first central cylinder 201, the distance between the respective nozzle and printing material web 02 and the position of the target region of the respective nozzle with respect to the circumferential angle. This results in a desirable printed image, produced on the basis of the actuation of all nozzles.

By aligning the printing material web 02, for example by means of a web edge aligner and optionally by means of the first impression roller 206 of the first printing unit 200, and by means of the large wrap angle of printing material web 02 around the at least one first central cylinder 201, and optionally by means of additional devices such as carriers, it is ensured that printing material web 02 is arranged without slip in a precisely defined position on the outer cylinder surface of the at least one first central cylinder 201 and remains in said position until a selective release thereof at the end of the region of the wrap angle. The contact of printing material web 02 with the outer cylinder surface of the at least one first central cylinder 201 also prevents or at least reduces to a sufficient degree the swelling of printing material web 02, at least in direction of transport B of printing material web 02 and at least for the duration of contact of a respective region of printing material web 02 with the outer cylinder surface of the at least one first central cylinder 201, even following contact with printing ink droplets. This serves to ensure that printing ink droplets from different print heads 211 are applied to a printing material web 02 that is disposed in a uniformly defined manner. The precise and constant positioning of printing material web 02 relative to the at least one first central cylinder 201 is of great importance to precise color registration and/or a true-to-register printed image, particularly if the actuation of the at least one nozzle is linked with the rotational position of the first central cylinder 201, as described above.

The nozzles of the at least one print head 212; 412; 701; 702; 703; 711; 712; 713; 721; 722; 723; 731; 732; 733 are arranged such that the distance between the nozzles and the printing material web 02 arranged on the outer cylinder surface of the at least one first central cylinder 201, at least when print head 212; 412; 701; 702; 703; 711; 712; 713; 721; 722; 723; 731; 732; 733 is in a printing position, preferably measures between 0.5 mm and 5 mm, and more preferably between 1 mm and 1.5 mm. The high angular resolution and/or the high sampling frequency of the rotational angle sensor and/or the high precision of the target data about the rotational position of first drive motor 208 of first central cylinder 201, predefined by the machine controller and processed by first drive motor 208 of first central cylinder 201, enable a highly precise determination and/or knowledge of the position of printing material web 02 relative to the nozzles and the target regions thereof. A droplet flight time between the nozzles and printing material web 02 is known, for example, based on a learning process and/or based on the known distance between the nozzles and printing material web 02 and a known droplet velocity. From the rotational angle position of the at least one first central cylinder 201 and/or of the first drive 208 of the at least one first central cylinder 201, the rotational speed of the at least one first central cylinder 201 and the droplet flight time, an ideal time for ejection of a respective droplet is determined, so that a precise color registration and/or true-to-register printing of the image on printing material web 02 is achieved.

At least one sensor embodied as a first printing image sensor is preferably provided, more preferably at a position downstream of first printing element 211 along the transport path of printing material web 02. The at least one first printed image sensor can be embodied, for example, as a first line camera or as a first surface camera. The at least one first printed image sensor is embodied, for example, as at least one CCD sensor and/or as at least one CMOS sensor. The actuation of all the print heads 212; 412; 701; 702; 703; 711; 712; 713; 721; 722; 723; 731; 732; 733 and/or double rows of print heads 212; 412; 701; 702; 703; 711; 712; 713; 721; 722; 723; 731; 732; 733 of first printing element 211, arranged and/or acting in succession in the circumferential direction of the at least one first central cylinder 201 is preferably monitored and/or controlled by means of this at least one first printed image sensor and a corresponding evaluation unit, for example the higher level machine controller. In a first embodiment of the at least one printed image sensor, only a first printed image sensor is provided, the sensor field of which encompasses the entire width of the transport path of printing material web 02. In a second embodiment of the at least one printed image sensor, only a first printed image sensor is provided, however it is embodied as movable in direction A, orthogonally to the direction of the transport path of printing material web 02. In a third embodiment of the at least one printed image sensor, a plurality of printed image sensors are provided, the respective sensor fields of which each encompass different regions of the transport path of printing material web 02. These regions are preferably arranged offset from one another in direction A, orthogonally to the direction of the transport path of printing material web 02. The total of the sensor fields of the plurality of printed image sensors preferably makes up one entire width of the transport path of printing material web 02.

The positioning of pixels formed by coating medium droplets, each of which emerges from a respective first print head 212; 412; 701; 702; 703; 711; 712; 713; 721; 722; 723; 731; 732; 733, is preferably compared with the positioning of pixels formed by coating medium droplets, each of which emerges from a respective second print head 212; 412; 701; 702; 703; 711; 712; 713; 721; 722; 723; 731; 732; 733 situated downstream of the respective first print head 212; 412; 701; 702; 703; 711; 712; 713; 721; 722; 723; 731; 732; 733 in the circumferential direction of the at least one first central cylinder 201 and/or in the provided transport direction B of printing material 02, and/or in the axial direction A relative to print head 212; 412; 701; 702; 703; 711; 712; 713; 721; 722; 723; 731; 732; 733. This is preferably carried out regardless of whether said respective first and second print heads 212; 412; 701; 702; 703; 711; 712; 713; 721; 722; 723; 731; 732; 733, which are arranged and/or act in succession in the circumferential direction of the at least one first central cylinder 201, are processing the same or a different coating medium. The correlation of the positions of the printed images emerging from different print heads 212; 412; 701; 702; 703; 711; 712; 713; 721; 722; 723; 731; 732; 733 is monitored. When the same coating media are used, the true-to-register merging of partial images is monitored. When different coating media are used, the color-to-color registration or color register is monitored. Quality control of the printed image is also preferably carried out based on the measured values of the at least one printed image sensor.

Depending on the speed with which individual nozzles can be actuated and operated, the printing material web 02 may need to be imprinted multiple times with the same printing ink until the desired result can be achieved. For this purpose, at least two double rows of print heads 212; 412; 701; 702; 703; 711; 712; 713; 721; 722; 723; 731; 732; 733, arranged one in front of the other in the circumferential direction of the first central cylinder 201, are preferably dedicated to each printing ink. At a transport speed of printing material web 02 of 2 m/s and a four-color printing process, a resolution of 600 dpi (600 dots per inch) is thus achieved, for example. Even higher web speeds of 150 m or more per minute are preferably possible. Lower resolutions and/or fewer ink colors enable correspondingly higher transport speeds.

During regular printing operation, all of print heads 212; 412; 701; 702; 703; 711; 712; 713; 721; 722; 723; 731; 732; 733 are arranged as stationary. This serves to ensure a consistently true-to-registration and/or true-to-register alignment of all nozzles. Various situations are conceivable in which a movement of print heads 212; 412; 701; 702; 703; 711; 712; 713; 721; 722; 723; 731; 732; 733 might be necessary. Such a situation arises, for example, during the installation and/or maintenance and/or replacement of at least one of print heads 212; 412; 701; 702; 703; 711; 712; 713; 721; 722; 723; 731; 732; 733. Print heads 212; 412; 701; 702; 703; 711; 712; 713; 721; 722; 723; 731; 732; 733 are preferably secured individually to the at least one nozzle bar 213 and can be individually removed from the at least one nozzle bar 213. This allows individual print heads 212; 412; 701; 702; 703; 711; 712; 713; 721; 722; 723; 731; 732; 733 to be maintained and/or cleaned and/or replaced. When a new print head 212; 412; 701; 702; 703; 711; 712; 713; 721; 722; 723; 731; 732; 733 and/or print head to be repositioned is mounted on the at least one nozzle bar 213 on which at least one other print head 212; 412; 701; 702; 703; 711; 712; 713; 721; 722; 723; 731; 732; 733 is already mounted, a precisely matching alignment of this new print head 212; 412; 701; 702; 703; 711; 712; 713; 721; 722; 723; 731; 732; 733 and/or print head to be repositioned with the at least one already mounted print head 212; 412; 701; 702; 703; 711; 712; 713; 721; 722; 723; 731; 732; 733, both in the circumferential direction and in the axial direction A with respect to the first central cylinder 201, will not necessarily occur, and will occur coincidentally at best. Thus in this case as well, an alignment may be necessary, particularly of an individual print head 212; 412; 701; 702; 703; 711; 712; 713; 721; 722; 723; 731; 732; 733 in relation to at least one or more other print heads 212; 412; 701; 702; 703; 711; 712; 713; 721; 722; 723; 731; 732; 733 212 of the same nozzle bar 213 and/or in relation to at least one or more other print heads 212; 412; 701; 702; 703; 711; 712; 713; 721; 722; 723; 731; 732; 733 of other nozzle bars 213. When a plurality of nozzle bars 213 that can be moved relative to one another is provided, minimal misalignments of the nozzle bars 213 relative to one another may occur during the return of at least one nozzle bar 213 to its printing position.

Preferably, at least two alignment sensors 740; 741 are provided. The at least two alignment sensors 740; 741 serve to detect data regarding the settings of at least four print heads 212; 412; 701; 702; 703; 711; 712; 713; 721; 722; 723; 731; 732; 733 relative to one another, for example. The at least two alignment sensors 740; 741 are preferably optical sensors. Such relative settings are, for example, relative geometric positionings of print heads 212; 412; 701; 702; 703; 711; 712; 713; 721; 722; 723; 731; 732; 733 and/or relative actuation times, in particular droplet ejection times of print heads 212; 412; 701; 702; 703; 711; 712; 713; 721; 722; 723; 731; 732; 733. The relative settings are additionally or alternatively relative settings, for example, that relate to at least one ink density and/or at least one area coverage and/or at least one dot size of generated pixels. In the following, the relative settings relate to geometric positionings and/or actuation times, in particular droplet ejection times. However, the described devices and/or processes also relate to the other stated relative settings, where this is not contradicted.

The at least two alignment sensors 740; 741 are preferably embodied at least as position sensors 740; 741. The at least two alignment sensors 740; 741, in particular position sensors 740; 741, are embodied, for example, as cameras 740; 741 and/or as CCD sensors 740; 741 and/or as CMOS sensors 740; 741. The at least two alignment sensors 740; 741, in particular position sensors 740; 741, are preferably used for directly or indirectly detecting a position and/or actuation of at least two print heads 212; 412; 701; 702; 703; 711; 712; 713; 721; 722; 723; 731; 732; 733 relative to one another. For direct detection, at least one of the at least two alignment sensors 740; 741 is situated such that it is and/or can be aligned toward the nozzles of the respective print heads 212; 412; 701; 702; 703; 711; 712; 713; 721; 722; 723; 731; 732; 733, for example. For a preferred indirect detection, the at least two alignment sensors 740; 741 are preferably situated such that they can be and/or are aligned toward printing material 02 and/or are and/or can be aligned toward the transport route intended for the transport of printing material 02, and/or are situated such that they are and/or can be aligned toward at least one transfer element. Generated partial test images 718; 719 which are produced by the print heads 212; 412; 701; 702; 703; 711; 712; 713; 721; 722; 723; 731; 732; 733 that will be adjusted relative to one another can then be compared with test print images 714. This enables a respective position of the target region of at least one newly positioned and/or repositioned print head 212; 412; 701; 702; 703; 711; 712; 713; 721; 722; 723; 731; 732; 733 to preferably be detected, at least temporarily, relative to a position of the target region of at least one already positioned print head 212; 412; 701; 702; 703; 711; 712; 713; 721; 722; 723; 731; 732; 733. This is preferably accomplished by a comparison of the relative positions of pixels, generated by the respective print heads 212; 412; 701; 702; 703; 711; 712; 713; 721; 722; 723; 731; 732; 733 on printing material web 02, by means of a common alignment sensor 740; 741, in particular position sensor 740; 741. These relative positions of the pixels are preferably evaluated by means of an evaluation unit, for example the higher-level press controller.

Alternatively or additionally, the printing press is thus preferably characterized in that each of the at least two alignment sensors 740; 741 is and/or can be aligned toward a printing material 02 and/or toward at least one transfer element and/or toward at least two particularly adjacent print heads 212; 412; 701; 702; 703; 711; 712; 713; 721; 722; 723; 731; 732; 733.

For this purpose, the above-described at least one first printed image sensor, for example, is used as at least one alignment sensor 740; 741. Preferably, however, alignment sensors 740; 741 other than the above-described at least one first printed image sensor are used, for example alignment sensors 740; 741 that are specialized for this task.

Following an installation and/or maintenance and/or replacement and/or cleaning of at least one print head 212; 412; 701; 702; 703; 711; 712; 713; 721; 722; 723; 731; 732; 733, a test print for generating at least one test print image 717 is preferably run, in which the print head 212; 412; 701; 702; 703; 711; 712; 713; 721; 722; 723; 731; 732; 733 to be newly positioned and/or repositioned and at least one print head 212; 412; 701; 702; 703; 711; 712; 713; 721; 722; 723; 731; 732; 733 that serves as a reference print head or master print head transfer printing ink droplets to printing material web 02. The at least one test print image 717 is preferably detected automatically by means of at least one alignment sensor 740; 741, for example, the first printed image sensor. If a deviation of the actual position of the at least one print head 212; 412; 701; 702; 703; 711; 712; 713; 721; 722; 723; 731; 732; 733 to be newly positioned and/or repositioned from a target position is documented and detected based on the at least one test print image 717, the position of said print head 212; 412; 701; 702; 703; 711; 712; 713; 721; 722; 723; 731; 732; 733 in axial direction A is preferably adjusted automatically by means of at least one positioning device 751, and/or the actuation of the nozzles of said print head 212; 412; 701; 702; 703; 711; 712; 713; 721; 722; 723; 731; 732; 733 is preferably adjusted with respect to an actuation time, in particular a droplet ejection time.

An installation position of the at least one newly positioned and/or repositioned print head 212; 412; 701; 702; 703; 711; 712; 713; 721; 722; 723; 731; 732; 733 in transport direction B, provided for printing material 02, and/or in the circumferential direction with respect to the at least one first central cylinder 201 can be corrected particularly by temporarily actuating the nozzles of this and/or another involved print head 212; 412; 701; 702; 703; 711; 712; 713; 721; 722; 723; 731; 732; 733, preferably similarly to the above-described alignment of print heads 212; 412; 701; 702; 703; 711; 712; 713; 721; 722; 723; 731; 732; 733 of different double rows of print heads 212; 412; 701; 702; 703; 711; 712; 713; 721; 722; 723; 731; 732; 733. An installation position of the at least one newly positioned and/or repositioned print head 212; 412; 701; 702; 703; 711; 712; 713; 721; 722; 723; 731; 732; 733 in axial direction A or in transverse direction A is preferably corrected by means of the at least one positioning device 751.

The at least one alignment sensor 740; 741 then registers the at least one test print image 717. In particular, a plurality of such test print images 717 can be detected in succession by at least one single alignment sensor 740; 741, which is moved to different positions with respect to axial direction A for detecting at least some of the test print images 717, to check the positions of corresponding pixels there. It would also be possible to place a sufficient number of alignment sensors 740; 741 in relevant positions, so that axial movement of the alignment sensors 740, 741 is no longer necessary.

Preferably, each of a plurality of print heads 212; 412; 701; 702; 703; 711; 712; 713; 721; 722; 723; 731; 732; 733 has its own positioning device 751, and more preferably, each of the print heads 212; 412; 701; 702; 703; 711; 712; 713; 721; 722; 723; 731; 732; 733 has its own positioning device 751. If one print head 212; 412; 701; 702; 703; 711; 712; 713; 721; 722; 723; 731; 732; 733 is used as a reference print head or master print head, according to which all other print heads 212; 412; 701; 702; 703; 711; 712; 713; 721; 722; 723; 731; 732; 733 are aligned, then in principle, said print head 212; 412; 701; 702; 703; 711; 712; 713; 721; 722; 723; 731; 732; 733 used as a reference print head or master print head does not need its own positioning device 751. Preferably, however, each print head 212; 412; 701; 702; 703; 711; 712; 713; 721; 722; 723; 731; 732; 733 has its own positioning device 751. In that case, a master print head may be freely selected. Each such positioning device 751 has at least one positioning drive 752, which is preferably embodied as an electric motor, and more preferably as a multiphase motor. Positioning drive 752 has, for example, a spindle drive 752 and/or a rack and pinion. In another embodiment, positioning drive 752 has an eccentric and a cooperating groove. Each print head 212; 412; 701; 702; 703; 711; 712; 713; 721; 722; 723; 731; 732; 733 that has a positioning drive 752 is preferably situated so as to be movable at least parallel to axial direction A or to transverse direction A by means of its positioning drive 752.

The at least one positioning device 751 has at least one base body 753, for example. The at least one base body 753 preferably is and/or can be arranged as stationary relative to the at least one nozzle bar 213; 214 and/or is preferably identical to the at least one nozzle bar 213; 413. At least two suspension elements 754; 756, embodied, for example, as spring steel plates 754; 756, are located on the at least one base body 753. Print head 212; 412; 701; 702; 703; 711; 712; 713; 721; 722; 723; 731; 732; 733 is preferably attached to suspension elements 754; 756 directly or via at least one connecting element 757; 758. Print head 212; 412; 701; 702; 703; 711; 712; 713; 721; 722; 723; 731; 732; 733 is disposed so as to be movable by suspension elements 754; 756, preferably in axial direction A or transverse direction A relative to the at least one base body 753. Print head 212;

412; 701; 702; 703; 711; 712; 713; 721; 722; 723; 731; 732; 733 preferably has at least one first thrust body 757 and/or is more preferably rigidly connected, in particular, to at least one first thrust body 757. More preferably, the at least one first thrust body 757 is provided as a connection between print head 212; 412; 701; 702; 703; 711; 712; 713; 721; 722; 723; 731; 732; 733 and at least one of suspension elements 756. At least one spring element 759 is preferably disposed between the at least one first thrust body 757 and the at least one base body 753 with respect to axial direction A, more preferably such that the at least one first thrust body 757, and thus at the same time the print head 212; 412; 701; 702; 703; 711; 712; 713; 721; 722; 723; 731; 732; 733, is acted on by a spring force in axial direction A or in transverse direction A. Preferably, the at least one first thrust body 757 has a first inclined surface 761, which more preferably is in contact with a second inclined surface 762 of at least one second sliding body 763. The first inclined surface 761 of the at least one first thrust body 763 is preferably pressed by the at least one spring element 759 against the second inclined surface 762 of the at least one second thrust body 763. First inclined surface 761 and second inclined surface 762 are preferably parallel to one another. Preferably, a surface normal of first inclined surface 761 and/or of second inclined surface 762 points in or opposite a direction that deviates from axial direction A by more than 0° and less than 90°, in particular by 1° to 45°, more preferably by 1° to 25°.

The at least one second thrust body 763 is preferably movable in a thrust direction S, which has at least one component in a direction orthogonal to axial direction A or transverse direction A, and which more preferably is oriented orthogonally to axial direction A or transverse direction A. Preferably, the at least one second thrust body 763 is connected via a threaded connection 764 to at least one spindle 766, which is positioned as rotatable by means of the at least one positioning drive 752, preferably embodied as spindle drive 752. A rotation of spindle 766 then preferably effects a movement of the at least one second thrust body 763 in or opposite thrust direction S, which effects or at least permits a movement of first thrust body 757 and thus of print head 212; 412; 701; 702; 703; 711; 712; 713; 721; 722; 723; 731; 732; 733 via the second inclined surface 762 and the first inclined surface 761 in a movement counter to or in axial direction A or transverse direction A, dependent upon whether operation is against or with the spring force of the at least one spring element 759. Print head 212; 412; 701; 702; 703; 711; 712; 713; 721; 722; 723; 731; 732; 733 preferably has at least one flexible supply line 767 and/or at least one flexible data line 623, for example for a supply and/or discharge of coating medium and/or cleaning agent and/or a supply of electrical energy and/or a data connection with a print head controller 622. The at least one flexible supply line 767 preferably ensures that print head 212; 412; 701; 702; 703; 711; 712; 713; 721; 722; 723; 731; 732; 733 can be moved.

In the following, a preferred embodiment of the method for aligning the settings of print heads 212; 412; 701; 702; 703; 711; 712; 713; 721; 722; 723; 731; 732; 733 of a printing unit 200; 400 relative to one another will be described. The relative settings relate, by way of example, to geometric positionings and/or actuation times, particularly droplet ejection times of print heads 212; 412; 701; 702; 703; 711; 712; 713; 721; 722; 723; 731; 732; 733 relative to one another. The same also applies to cases in which the relative settings are additionally or alternatively embodied, for example, as relative settings that relate to at least one ink density and/or at least one area coverage and/or at least one dot size of generated pixels.

An exemplary full set 707 of at least four (4), for example twelve (12), preferably one hundred and twelve (112) print heads 212; 412; 701; 702; 703; 711; 712; 713; 721; 722; 723; 731; 732; 733 has a first subset 708 of at least two (2), for example six (6), preferably fifty-six (56) print heads 212; 412; 701; 702; 711; 721; 722; 731 and a second subset 709 of at least two (2), for example six (6), preferably fifty-six (56) print heads 212; 412; 703; 712; 713; 723; 732; 733. The full set 707 has two (2), for example, and preferably eight (8) double rows 213; 413 of print heads 212; 412; 701; 702; 703; 711; 712; 713; 721; 722; 723; 731; 732; 733 arranged in different positions with respect to transport direction B and/or the circumferential direction, each of which has at least two (2), for example six (6), preferably fourteen (14) print heads 212; 412; 701; 702; 703; 711; 712; 713; 721; 722; 723; 731; 732; 733 in different positions with respect to axial direction A or transverse direction A. A separation of first subset 708 from second subset 709 preferably extends substantially parallel to transport direction B and/or the circumferential direction, and orthogonally to axial direction A or transverse direction A.

Printing unit 200; 400 preferably has at least one support device 742, on which the at least two alignment sensors 740; 741 are particularly movably disposed. The at least one support device 742 preferably has at least one sensor drive. The at least one alignment sensor 740; 741 is arranged so as to be partially movable with at least one component in axial direction A or transverse direction A, for example by means of the at least one sensor drive. Each alignment sensor 740; 741 has its own support device 742, for example; preferably, however, a common support device 742 is provided. The at least one support device has at least one guide, for example, along which the at least one alignment sensor 740; 741 is movably arranged. Preferably, each movable alignment sensor 740; 741 has its own sensor drive. The at least one sensor drive has, for example, at least one traction means, for example at least one belt, which can be moved in different directions by means of a motor. Alternatively, a spindle drive or some other linear motor or some other suitable drive may also be used.

First, a print head 711 of the first subset 708 is designated as the first primary master print head 711; 728 of the first subset 708, and a print head 703 of the second subset 709 is designated as the second primary master print head 703; 729 of the second subset 709. At least one (1), for example four (4), preferably sixteen (16) additional print heads 701; 702; 721; 722 of the first subset 708, defined as first primary slave print heads 701; 702; 721; 722, are then aligned with the first primary master print head 711; 728 of the first subset, that is to say their position is aligned therewith. This is preferably accomplished in that first a test print image 717 is printed, consisting of a plurality of lines which extend partially parallel to transport direction B of printing material 02 and/or to the circumferential direction of central cylinder 201; 401, and which extend partially orthogonally thereto and/or parallel to axial direction A or transverse direction A. In this process, a first partial test image 718 is printed by the first primary master print head 728 and a second partial test image 719 is printed by one of the first primary slave print heads 701; 702; 721; 722. The test print image is detected by means of a first alignment sensor 740. The test print image 717 can preferably be used to determine mechanically whether or not the relative positions of the first primary master print head 711; 728 and the corresponding first primary slave print head 701; 702; 721; 722 should be modified. Where appropriate, an alignment is carried out, preferably by means of the corresponding positioning device 751 of the first primary slave print head 701; 702; 721; 722. All the first primary slave print heads 701; 702; 721; 722 are aligned in a similar manner. A similar alignment of second primary slave print heads 712; 713; 732; 733 in relation to a second primary master print head 703; 729 is preferably carried out at the same time in the second subset 708, in particular by means of the second alignment sensor 741 and by means of a corresponding test print image 717.

Afterward, one of the print heads 701; 702; 721; 722 previously designated as a first primary slave print head 701; 702; 721; 722 is designated as the first secondary master print head 722; 728, and one of the print heads 712; 713; 732; 733 previously designated as a second slave print head 712; 713; 732; 733 is designated as the second master print head 713; 729. First secondary slave print heads 731 and second secondary slave print heads 723 are designated, and the positions of each relative to the secondary master print head 722; 728; 713; 729 are adjusted similarly by means of test print images 717, alignment sensors 740; 741 and positioning devices 752. Since the secondary master print heads 722; 728; 713; 729 have already been aligned with the primary master print heads 711; 728; 703; 729, now both the primary slave print heads 701; 702; 721; 722; 712; 713; 732; 733 and the secondary slave print heads 731; 723 are aligned with the primary master print heads 711; 728; 703; 729. Depending on the number of print heads 212; 412; 701; 702; 703; 711; 712; 713; 721; 722; 723; 731; 732; 733 within the subsets 708; 709, the process is continued similarly until, as already in the example, all the print heads 212; 412; 701; 702; 703; 711; 712; 713; 721; 722; 723; 731; 732; 733 are aligned at least within their subsets 708; 709.

Figure 4A:
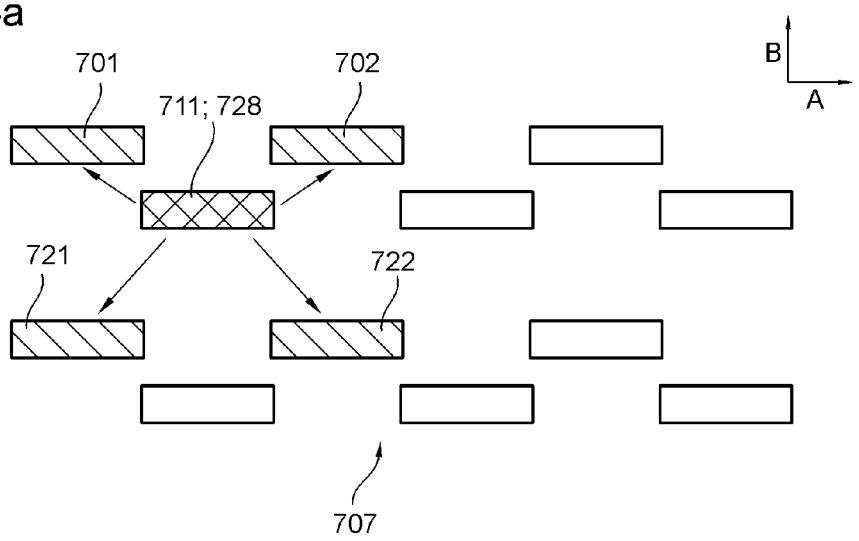
FIG. 4*a* a schematic of an undivided full set of print heads during a detection process.
Figure 4B:
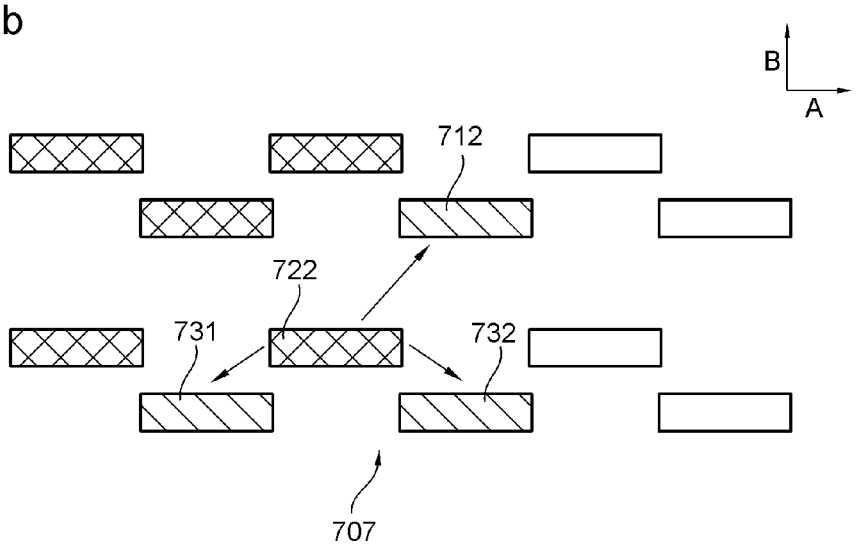
FIG. 4*b* a schematic of an undivided full set of print heads during a detection process.
Figure 4C:
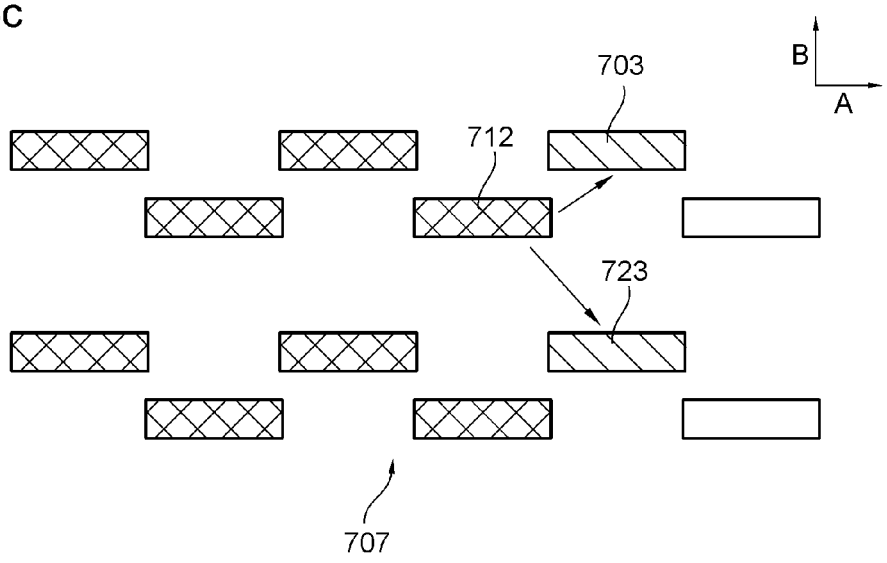
FIG. 4*c* a schematic of an undivided full set of print heads during a detection process.
Figure 4D:
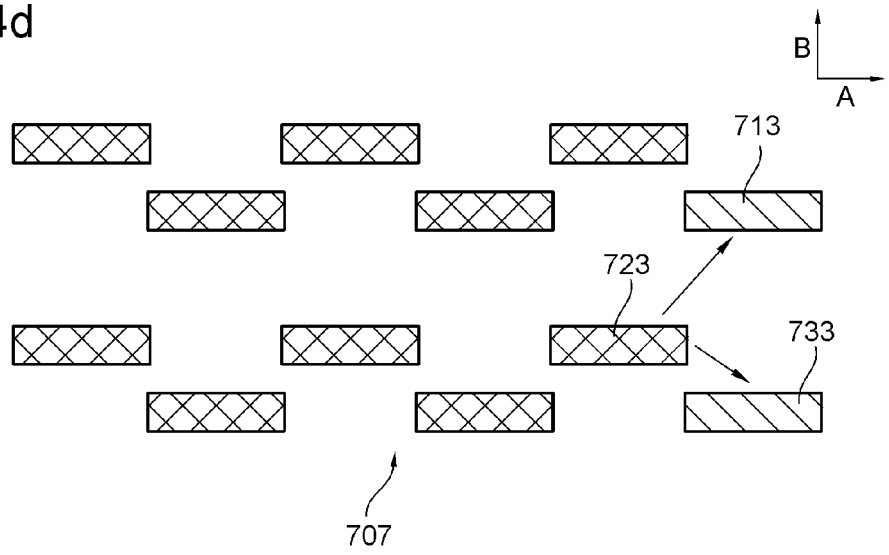
FIG. 4*d* a schematic of an undivided full set of print heads during a detection process.
Figure 4E:
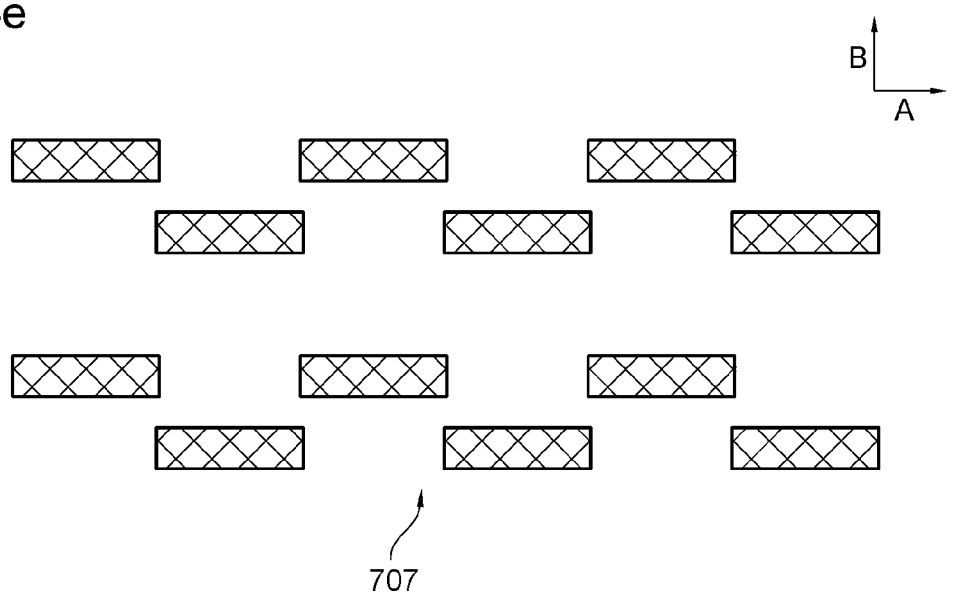
FIG. 4*e* a schematic of an undivided full set of print heads during a detection process.
Figure 5A:
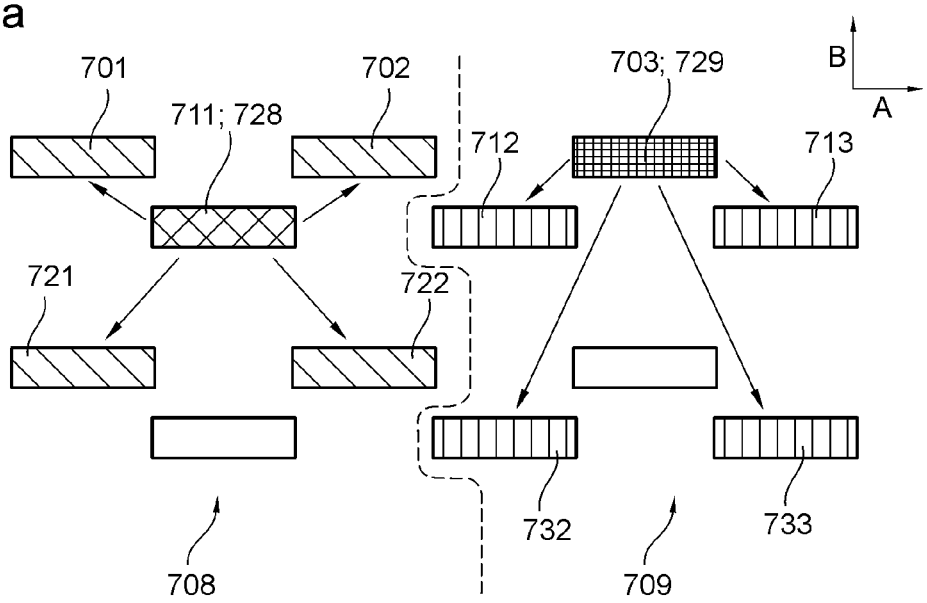
FIG. 5*a* a schematic of a full set of print heads, divided into subsets, during a detection process.
Figure 5B:
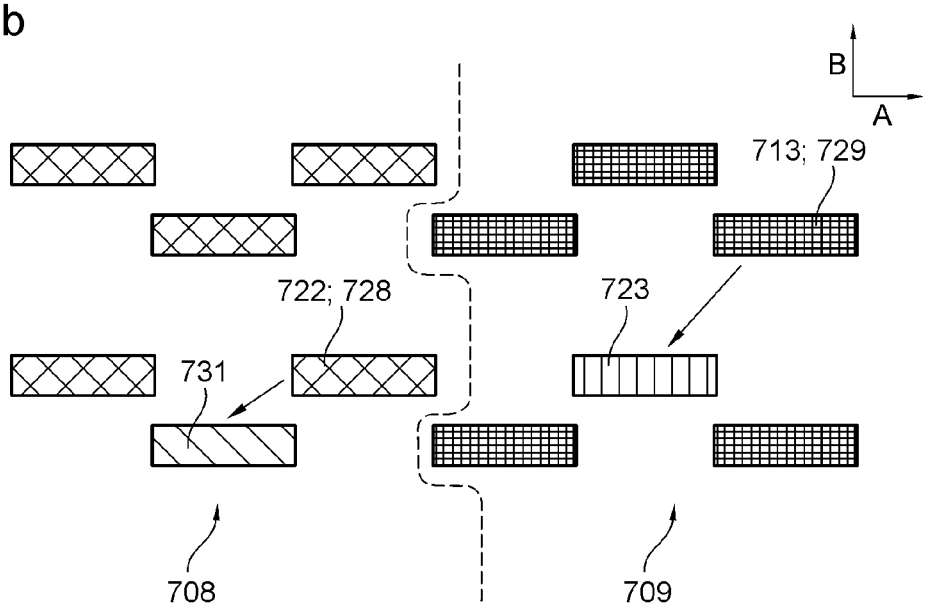
FIG. 5*b* a schematic of a full set of print heads, divided into subsets, during a detection process.
Figure 5C:
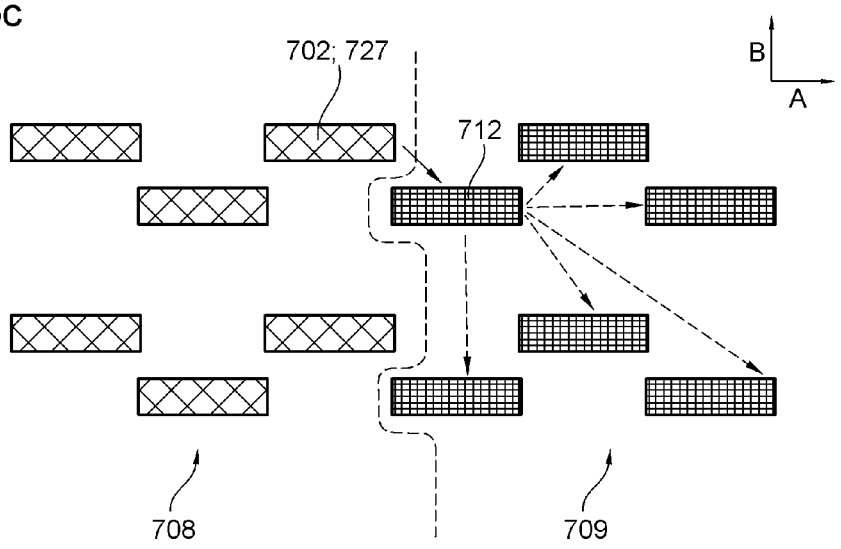
FIG. 5*c* a schematic of a full set of print heads, divided into subsets, during a detection process.
Figure 5D:
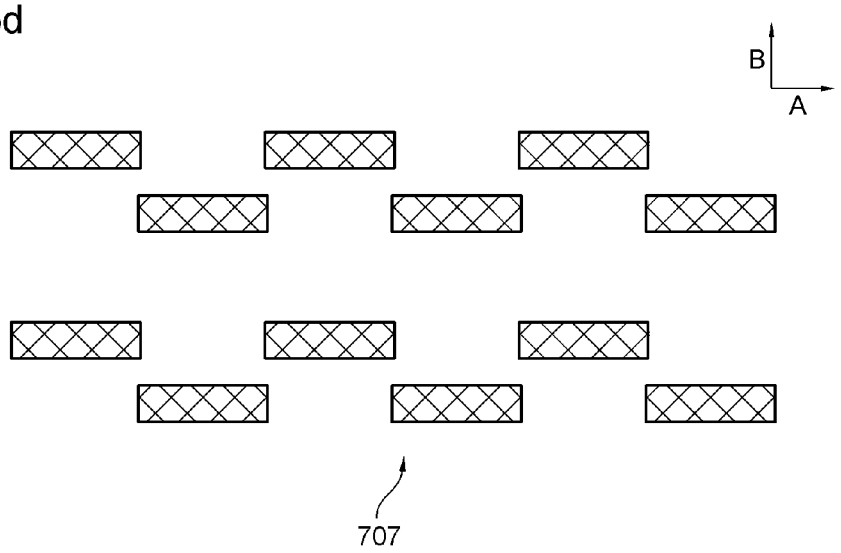
FIG. 5*d* a schematic of a full set of print heads, divided into subsets, during a detection process.
Figure 6:
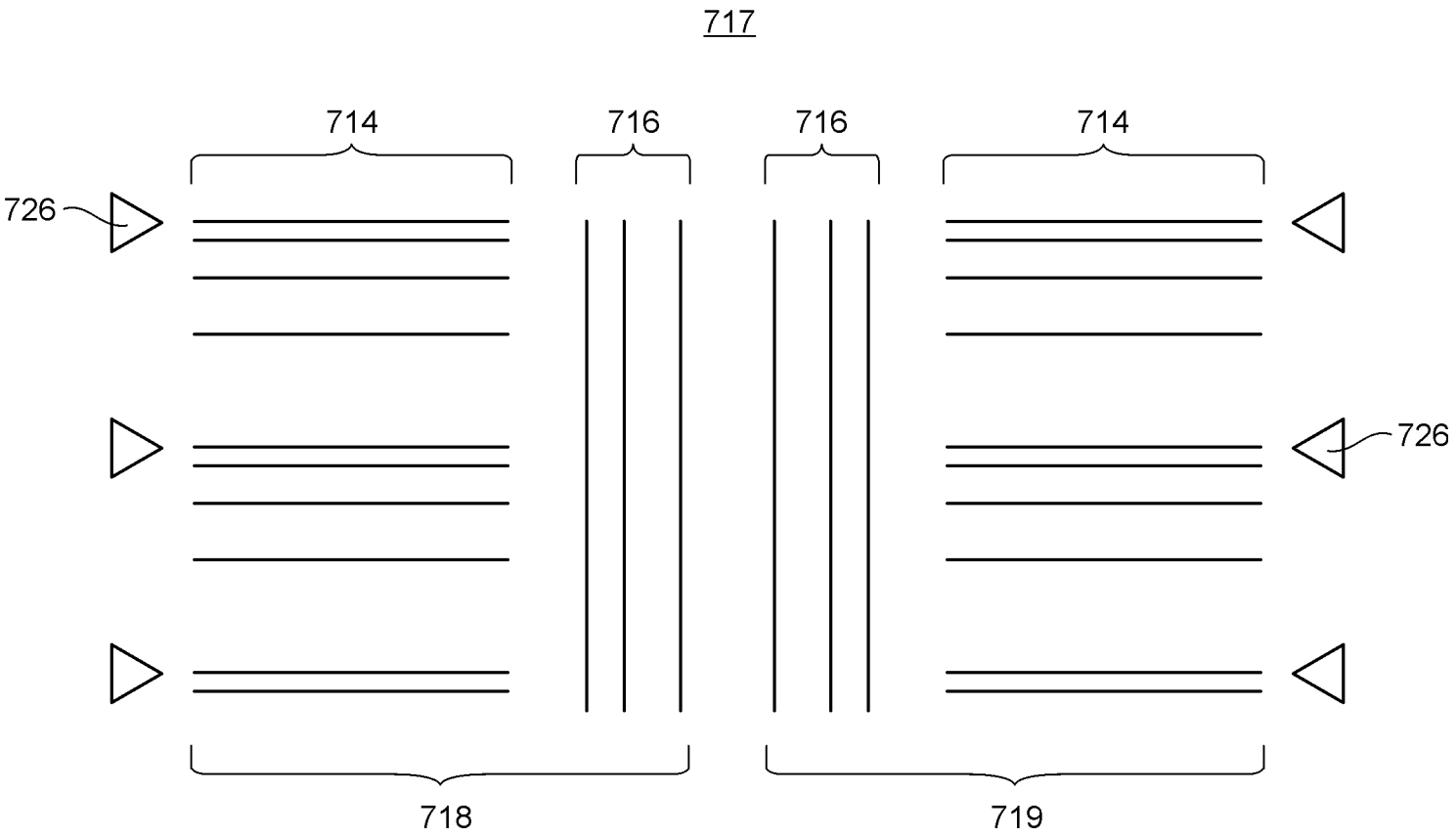
FIG. 6 a schematic representation of a test print image.
Figure 7:
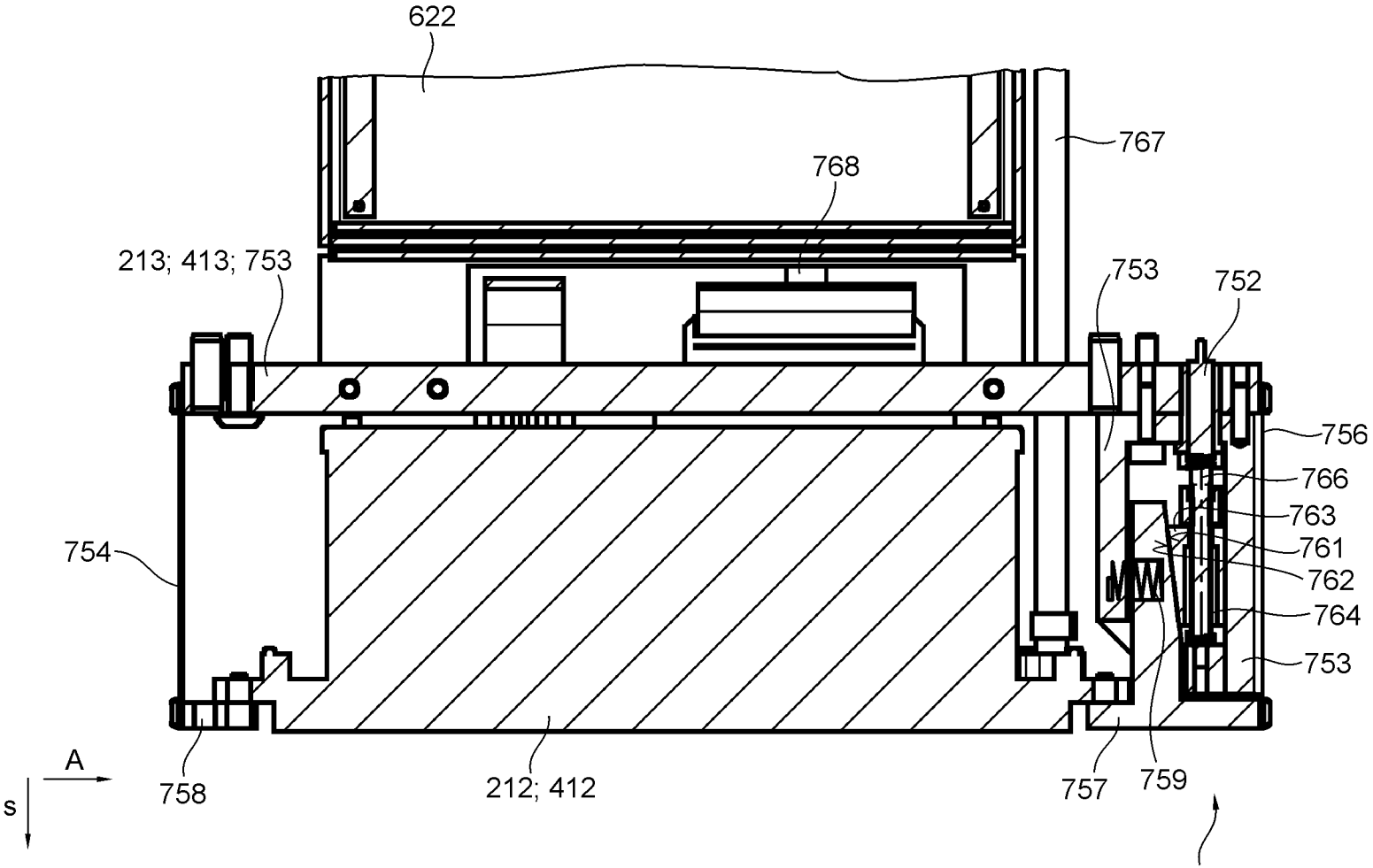
FIG. 7 a schematic representation of a positioning device for a print head.

Afterward, particularly following the above step, the subsets 708; 709 are aligned with one another. This process is also carried out similarly. One print head 702 of the first subset 708, which print head is preferably adjacent to the second subset 709, is designated as the overall master print head 702; 727. One print head 712 of the second subset 709, which is preferably adjacent to the first subset 708, is defined as the overall slave print head 712. A test print image 717 is produced accordingly by the overall master print head 702; 727 and the overall slave print head 712 together and is detected by means of one of the alignment sensors 740; 741, which in the meantime is preferably positioned appropriately. Once this test print image 717 has been evaluated, the specifications as to how far the overall slave print head 712 must be moved in relation to overall master print head 702; 727 are fixed. To maintain the positioning that has already been achieved of all print heads 212; 412; 703; 712; 713; 723; 732; 733 of the second subset 709, the positions of all the print heads 212; 412; 703; 712; 713; 723; 732; 733 of the second subset 709 are adjusted according to the specifications determined for the overall slave print head 712, in particular by means of their positioning devices 752. At that point, all of print heads 212; 412; 701; 702; 703; 711; 712; 713; 721; 722; 723; 731; 732; 733 are aligned relative to one another. To accomplish this, fewer processes are required than when the print heads 212; 412; 701; 702; 703; 711; 712; 713; 721; 722; 723; 731; 732; 733 are aligned in succession (FIGS. 4*a*, b, c, d and e). Depending on the number of print heads 212; 412; 701; 702; 703; 711; 712; 713; 721; 722; 723; 731; 732; 733, it may be even more time-saving to form more than two subsets 708; 709, and accordingly to provide more than two alignment sensors 740; 741. It is also conceivable to provide a number of alignment sensors that is one less than the number of print heads in each double row. In that case, it is not necessary to move alignment sensors 740; 741, allowing additional time savings to be achieved.

As described, each of the relative positions is preferably adjusted immediately following the detection, that is to say, the respective alignment process is carried out at once. This enables the desired positions to always be reached instantly, and enables a verification and, for example, an iterative procedure. Alternatively, only the detection processes may be carried out in the described order. With correspondingly accurate measurement and reliable positioning devices 752, the aligned positions can then be calculated and adjusted for all print heads 212; 412; 701; 702; 703; 711; 712; 713; 721; 722; 723; 731; 732; 733 simultaneously. This enables an additional time savings, although the possibility of iteration and/or immediate verification is sacrificed.

In the case of actuation times, in particular droplet ejection times, the times at which the respective print heads eject coating medium are preferably aligned with one another. The detection processes are preferably the same as has been described for the positioning, with the exception that the test print image 717 is evaluated differently. The changes then involve only an actuation of the nozzles. In this case as well, the process can be implemented iteratively and/or with verification or by means of a single measurement and a sufficiently precise prediction.

The at least one test print image 717 preferably has at least two partial test images 718; 719, which are produced by different print heads 212; 412; 701; 702; 703; 711; 712; 713; 721; 722; 723; 731; 732; 733. Preferably, each partial print image 718; 719 has at least one longitudinal image element 716, more preferably at least two longitudinal image elements 716. Each longitudinal image element 716 preferably extends further at least in transport direction B of printing material 02 than orthogonally to this transport direction B of printing material 02. From the relative positions of the longitudinal image elements 716 of different partial test images 718; 719, the relative axial positions of the print heads 212; 412; 701; 702; 703; 711; 712; 713; 721; 722; 723; 731; 732; 733, in particular the group of print heads 212; 412; 701; 702; 703; 711; 712; 713; 721; 722; 723; 731; 732; 733 that are involved in producing the partial test images 718; 719, is preferably inferred. Each partial print image 718; 719 preferably has at least one transverse image element 714 and more preferably at least two transverse image elements 714. Each transverse image element 714 preferably extends further at least in axial direction A or transverse direction A than its extension orthogonally to this axial direction A or transverse direction A. From the relative positions of the transverse image elements 714 of different partial test images 718; 719, the relative actuation times, particularly droplet ejection times of the print heads 212; 412; 701; 702; 703; 711; 712; 713; 721; 722; 723; 731; 732; 733, in particular the group of print heads 212; 412; 701; 702; 703; 711; 712; 713; 721; 722; 723; 731; 732; 733 that are involved in producing the partial test images 718; 719, is preferably inferred. The at least one test print image 717 further preferably has limiting elements 726. Limiting elements 726 enable and/or facilitate, for example, a proper alignment of the respective detection sensor 740; 741 with respect to axial direction A or transverse direction A.

After printing material web 02 has passed the at least one first printing unit 200, printing material web 02 is transported further along its transport path and is preferably fed to the at least one first dryer 301 of the at least one dryer unit 300. The at least one first dryer 301 is preferably embodied as an air flow dryer 301 and/or radiation dryer 301 and/or hot-air dryer 301 and/or infrared radiation dryer 301.

Along the transport path of printing material web 02, at least one second printing unit 400 is preferably provided. The transport path of printing material web 02 through the at least one second printing unit 400 extends similarly to the transport path through the at least one first printing unit 200. Within second printing unit 400, at least one second printing element 411, embodied as an inkjet printing element 411 or ink-jet printing element 411, is preferably provided, aligned toward the second central cylinder 401. The at least one second printing element 411 of the at least one second printing unit 400 is preferably identical in configuration to the at least one first printing element 211 of the at least one first printing unit 200, particularly with respect to at least one nozzle bar 413, at least one print head 412 embodied as an inkjet print head 412, and the arrangement thereof in double rows, the implementation and resolution of the printing process, the arrangement, alignment and control of the nozzles and the movability and adjustability of the at least one nozzle bar 413 and of the at least one print head 412 by means of at least one adjustment mechanism having a corresponding electric motor. The proper alignment of the print heads 412 of the at least one second printing unit 400 is preferably verified in that at least two alignment sensors 740; 741 detect respective printed test print images 717 and evaluate the press control of these test print images 717. The at least one second printing element 411 is preferably embodied as a multicolor printing element 411, in particular a four-color printing element 411. Downstream of the at least one second printing unit 400 with respect to the transport path of printing material web 02, at least one second dryer 331 of the at least one dryer unit 300 is preferably arranged. The configuration of the at least one second dryer 331 is preferably identical to the configuration of the at least one first dryer 301.

In at least one variant of the printing press, printing press 01 is embodied as a web-fed rotary inkjet printing press 01, and at least one transfer body is arranged so as to form a transfer nip with the at least one first central printing cylinder 201. In that case, the at least one print head 212; 412; 701; 702; 703; 711; 712; 713; 721; 722; 723; 731; 732; 733 is preferably aligned toward the at least one transfer body. In this case, central printing cylinder 201 is preferably embodied as an impression cylinder.

The at least one first central printing cylinder 201 is preferably a motorized rotational body 201 that serves to support a printing material web 02 in a first transfer region, in particular a first transfer region for coating medium. The at least one second central printing cylinder 401 is preferably a motorized rotational body 401 that serves to support a printing material web 02 in a second transfer region, in particular a second transfer region for coating medium. The first and/or the second transfer region is preferably a region that is provided for making contact between printing material 02 and coating medium, for example a target region of at least one nozzle of at least one print head 212; 412; 701; 702; 703; 711; 712; 713; 721; 722; 723; 731; 732; 733 and/or at least one working region of at least one print head 212; 412; 701; 702; 703; 711; 712; 713; 721; 722; 723; 731; 732; 733 and/or an entire working region of at least one nozzle bar 213 and/or a nip which is formed by the respective central printing cylinder 201; 401 with an optionally provided transfer body.

While a preferred embodiment or a method for adapting relative settings of print heads and a printing press in accordance with the present invention have been set forth fully and completely hereinabove, it will be apparent to one of skill in the art that various changes could be made without departing from the true spirit and scope of the subject invention which is accordingly to be limited only by the appended claims.

The invention claimed is:

1. A method for aligning the settings of print heads (212; 412; 701; 702; 703; 711; 712; 713; 721; 722; 723; 731; 732; 733) of at least one printing unit (200; 400) of a printing press (01) relative to one another, wherein in at least one first partial detection process, data regarding the settings of at least two print heads (212; 412; 701; 702; 711; 721; 722; 731) of a first subset (708) of print heads (212; 412; 701; 702; 703; 711; 712; 713; 721; 722; 723; 731; 732; 733) relative to one another are detected, and wherein in at least one second partial detection process, data regarding the settings of at least two print heads (212; 412; 703; 712; 713; 723; 732; 733) of a second subset (709) of print heads (212; 412; 701; 702; 703; 711; 712; 713; 721; 722; 723; 731; 732; 733), which do not belong to the first subset (708), relative to one another are detected, and wherein, proceeding from each print head (212; 412; 701; 702; 703; 711; 712; 713; 721; 722; 723; 731; 732; 733) of the at least one first subset (708), print heads (212; 412; 701; 702; 703; 711; 712; 713; 721; 722; 723; 731; 732; 733) of the at least one second subset (709) are arranged in only one direction with respect to the transverse direction (A), and/or in that, proceeding from each print head (212; 412; 701; 702; 703; 711; 712; 713; 721; 722; 723; 731; 732; 733) of the at least one second subset (709), print heads (212; 412; 701; 702; 703; 711; 712; 713; 721; 722; 723; 731; 732; 733) of the at least one first subset (708) are arranged in only one direction with respect to a transverse direction (A), and wherein in at least one full detection process, data regarding at least one setting of at least one first print head (212; 412; 701; 702; 711; 721; 722; 731) of the first subset (708) and at least one second print head (212; 412; 703; 712; 713; 723; 732; 733) of the second subset (709) relative to one another are detected, and wherein at least the at least one first partial detection process and the at least one second partial detection process are carried out at least partially simultaneously, and wherein at all times during the process, at most either the at least one full detection process is underway, or the at least one first partial detection process and/or the at least one second partial detection process is underway, and wherein in at least one adjustment process, the settings of at least two of the print heads (212; 412; 701; 702; 703; 711; 712; 713; 721; 722; 723; 731; 732; 733) of the at least one printing unit (200; 400) relative to one another are modified, and wherein the data acquired during the at least one first partial detection process and/or the data acquired during the at least one second partial detection process and/or the data acquired during the at least one full detection process are detected by means of at least two alignment sensors (740; 741) that can be moved, at least with respect to a transverse direction (A), and wherein at least two alignment sensors (740; 741) are moved, at least temporarily, independently of one another, at least in a transverse direction (A).

2. The method according to claim 1, characterized in that the relative settings are relative geometric positionings and/or actuation times of the print heads (212; 412; 701; 702; 703; 711; 712; 713; 721; 722; 723; 731; 732; 733).

3. The method according to claim 1, characterized in that each print head belongs at most to the at least first subset (708) or the at least one second subset (709) and/or in that the first subset (708) and the second subset (709) have no intersection.

4. The method according to claim 1, characterized in that the settings of the at least two print heads (212; 412; 701; 702; 703; 711; 712; 713; 721; 722; 723 ; 731; 732; 733) relative to one another are modified dependent on at least the data that are acquired in the at least one first partial detection process and/or dependent on the data that are acquired in the at least one second partial detection process and/or dependent on the data that are acquired during the full detection process.

5. The method according to claim 1, characterized in that that at least one alignment sensor (740; 741) is moved, at least temporarily, at least in a transverse direction (A), between the at least one first partial detection process and the at least one full detection process.

6. The method according to claim 1, characterized in that each of the at least two alignment sensors (740; 741) detects at least one print image located on at least one printing material (02) and/or on at least one transfer body, and/or at least two print heads (212; 412; 701; 702; 703; 711; 712; 713; 721; 722; 723; 731; 732; 733).

7. The method according to claim 1, characterized in that the at least one first subset (708) and the at least one second subset (709) each have at least one print head (212; 412; 701; 702; 703; 711; 712; 713; 721; 722; 723; 731; 732; 733), by means of which a common coating medium can be applied and/or the application of the common coating medium can be influenced.

8. The method according to claim 1, characterized in that in at least one first partial alignment process, the settings of the at least two print heads (212; 412; 701; 702; 711; 721; 722, 731) of the at least one first subset (708) relative to one another are modified, and/or in that in at least one second partial alignment process, the settings of the at least two print heads (212; 412; 703; 712, 713, 723; 732; 733) of the at least one second subset (709) relative to one another are modified, and/or in that in at least one full alignment process, the settings of the at least one first print head (212; 412; 701; 702; 711; 721; 722; 731) of the first subset (708) and at least one second print head (212; 412; 703; 712; 713; 723; 732; 733) of the second subset (709) relative to one another are modified.

9. A printing press (01) having at least one printing unit (200, 400), wherein the at least one printing unit (200, 400) has at least four print heads (212; 412; 701; 702; 703; 711; 712; 713, 721, 722, 723; 731; 732; 733), at least three of which are arranged as movable relative to one another, at least in a transverse direction (A), which is oriented orthogonally to a transport direction (B) provided for the transport of printing material (02) through the at least one printing unit (200, 400), and wherein the at least three groups each contain at least two of the at least four print heads (212; 412; 701; 702; 703; 711; 712; 713; 721; 722; 723; 731; 732; 733), characterized that the printing press (02) has at least two alignment sensors (740; 741), by means of which, for a total of at least three groups of print heads (212, 412, 701; 702; 703; 711; 712; 713; 721; 722; 723; 731; 732, 733), data regarding the settings of the print heads (212; 412; 701; 702; 703; 711; 712; 713, 721, 722, 723; 731; 732; 733) of each group relative to one another can be detected, and in that the at least two alignment sensors (740; 741) are each arranged as at least partially movable with at least one component in the transverse direction (A), and in that at least one of the at least two alignment sensors (740; 741) has its own sensor drive, which is different from a sensor drive of another of the at least two alignment sensors (740; 741).

10. The printing press according to claim 9, characterized in that each print head (212; 412; 701; 702; 703; 711; 712; 713; 721; 722; 723; 731; 732; 733) that can be moved in the transverse direction (A) has its own positioning drive (752), and/or in that each movable alignment sensor (740; 741) has its own sensor drive.

11. The printing press according to claim 9, characterized in that the relative settings are relative geometric positionings and/or actuation times of the print heads (212; 412; 701; 702; 703; 711; 712; 713; 721; 722; 723; 731; 732; 733).

12. The printing press according to claim 9, characterized in that the printing unit (200; 400) has at least four print heads (212; 412; 701; 702; 703; 711; 712; 713; 721; 722; 723; 731; 732; 733), which are allocated to the same coating medium reservoir, and which are arranged at least partially offset from one another with respect to the transverse direction (A), in each case as viewed in pairs.

13. The printing press according to claim 9, characterized in that the printing unit (200; 400) has at least one double row of print heads (212; 412; 701; 702; 703; 711; 712; 713; 721; 722; 723; 731; 732; 733), having two rows, offset from one another with respect to the transverse direction (A), each containing at least two print heads (212; 412; 701; 702; 703; 711; 712; 713; 721; 722; 723; 731; 732; 733).

14. The printing press according to claim 9, characterized in that each of the at least two alignment sensors (740; 741) is and/or can be aligned toward a printing material (02) and/or toward at least one transfer body and/or toward at least two, in particular adjacent print heads (212; 412; 701; 702; 703; 711; 712; 713; 721; 722; 723; 731; 732; 733).

15. The printing press according to claim 9, characterized in that at least two of the at least two alignment sensors (740; 741) are arranged so as to each be movable, independently of one another and/or independently of the print heads (212; 412; 701; 702; 703; 711; 712; 713; 721; 722; 723; 731; 732; 733), at least partially with at least one component in the transverse direction (A).

* * * * *